US008568129B2

(12) United States Patent
LaCroix et al.

(10) Patent No.: US 8,568,129 B2
(45) Date of Patent: Oct. 29, 2013

(54) FLOATING CUT-OFF BAR FOR A MOLD BOX

(75) Inventors: David M. LaCroix, St. Paul, MN (US); Robert A. MacDonald, Plymouth, MN (US)

(73) Assignee: Keystone Retaining Wall Systems LLC, West Chester, OH (US)

( * ) Notice: Subject to any disclaimer, the term of this patent is extended or adjusted under 35 U.S.C. 154(b) by 519 days.

(21) Appl. No.: 12/793,243

(22) Filed: Jun. 3, 2010

(65) Prior Publication Data

US 2010/0308502 A1 Dec. 9, 2010

Related U.S. Application Data

(60) Provisional application No. 61/183,721, filed on Jun. 3, 2009, provisional application No. 61/183,611, filed on Jun. 3, 2009.

(51) Int. Cl.
*B28B 3/00* (2006.01)

(52) U.S. Cl.
USPC ..... 425/449; 425/64; 425/219; 425/447

(58) Field of Classification Search
USPC ..... 425/219, 253, 256, 346, 443, 64, 218, 425/447, 449; 249/112
See application file for complete search history.

(56) References Cited

U.S. PATENT DOCUMENTS

| | | | |
|---|---|---|---|
| 1,905,975 | A | 4/1933 | Thomas |
| 2,652,613 | A | 9/1953 | Warren |
| 2,821,005 | A | 1/1958 | Davis |
| 2,839,810 | A | 6/1958 | Kovach |
| 2,948,043 | A | 8/1960 | Gory |
| 3,213,511 | A | 10/1965 | Petruzzi |
| 3,277,551 | A | 10/1966 | Hidco |
| 3,397,435 | A | 8/1968 | Jelesiewicz |
| 3,655,318 | A | 4/1972 | Schneider et al. |
| 3,833,331 | A | 9/1974 | Springs |
| 3,879,156 | A | 4/1975 | Buhrer et al. |

(Continued)

FOREIGN PATENT DOCUMENTS

| | | |
|---|---|---|
| DE | 102 17 199 C1 | 9/2003 |
| EP | 0 547 305 A2 | 6/1993 |

(Continued)

OTHER PUBLICATIONS

International Search Report and Written Opinion for application PCT/US2009/050259, mailed Nov. 6, 2009 (9 pages).

(Continued)

*Primary Examiner* — Yogendra Gupta
*Assistant Examiner* — Emmanuel S Luk
(74) *Attorney, Agent, or Firm* — Popovich, Wiles & O'Connell, P.A.

(57) ABSTRACT

A floating cut-off bar coupled to a feed drawer whereby a mechanism allows the floating cut-off bar to engage the specified contour of side rails and a division plate in a mold box assembly and aid in material distribution by screeding excess material and delivering additional material to areas of the mold box as necessary and method of making wall blocks therefrom. The specified contour of the side rails and optionally division plate is designed to optimally deliver material to achieve a specified uniform density of the block produced for greater structural integrity, strength and durability of the block.

15 Claims, 23 Drawing Sheets

(56) References Cited

U.S. PATENT DOCUMENTS

| | | | |
|---|---|---|---|
| 3,885,900 | A | 5/1975 | Kanta |
| 3,942,923 | A | 3/1976 | Binion |
| 4,019,848 | A | 4/1977 | Balhorn |
| 4,035,124 | A | 7/1977 | Balhorn |
| 4,131,670 | A | 12/1978 | Abate |
| 4,260,352 | A | 4/1981 | Balhorn |
| 4,272,230 | A | 6/1981 | Abate |
| 4,936,763 | A | 6/1990 | Thomas |
| 5,503,546 | A | 4/1996 | Aaseth et al. |
| 5,634,344 | A | 6/1997 | Yamauchi |
| 5,934,343 | A | 8/1999 | Gaylo et al. |
| 6,213,754 | B1 | 4/2001 | Doty et al. |
| 6,352,236 | B1 | 3/2002 | Aaseth et al. |
| 6,387,307 | B1 | 5/2002 | Bossetti |
| 6,998,075 | B2 | 2/2006 | Sandqvist |
| 7,470,121 | B2 | 12/2008 | Ness et al. |
| 7,635,261 | B2 | 12/2009 | High et al. |
| 7,687,005 | B2 | 3/2010 | Skidmore et al. |
| 8,002,536 | B2 | 8/2011 | Ness et al. |
| 2001/0052654 | A1 | 12/2001 | Saddler et al. |
| 2003/0006521 | A1 | 1/2003 | Rivola |
| 2003/0160347 | A1 | 8/2003 | Saddler et al. |
| 2010/0007051 | A1 * | 1/2010 | Ness et al. ..... 264/299 |

FOREIGN PATENT DOCUMENTS

| | | | |
|---|---|---|---|
| EP | 0 659 526 | A1 | 6/1995 |
| EP | 0 685 350 | A1 | 12/1995 |
| GB | 588 856 | A | 6/1947 |
| JP | 53 061618 | A | 6/1978 |
| WO | WO 98/23424 | A2 | 6/1998 |

OTHER PUBLICATIONS

Abstract for DE 102 17 199 C1 (1 page), Sep. 4, 2003

Oct. 14, 2010 International Search Report and Written Opinion for PCT Application No. PCT/US2010/037238 (14 pages).

* cited by examiner

FLOATING CUT-OFF BAR FOR A MOLD BOX

This application claims the benefit of U.S. Provisional Application No. 61/183,721, filed Jun. 3, 2009, entitled "Floating Cut-Off Bar for a Mold Box", the contents of which are hereby incorporated by reference herein.

The contents of U.S. Provisional Application No. 61/183,611, filed Jun. 3, 2009, entitled "Floating Cut-Off Bar and Method of Use Thereof", and U.S. application Ser. No. 12/580,368, filed Oct. 16, 2009, entitled "Floating Cut-Off Bar and Method of Use Thereof", are hereby incorporated by reference herein.

FIELD OF THE INVENTION

The present invention relates generally to the production of concrete wall blocks with equal material distribution throughout the mold cavity of the block to produce structurally durable, strong and sound blocks. More particularly the invention relates to producing wall blocks with the use of a floating cut-off bar that is separated but movably coupled to a feed drawer for more equal distribution of the mix material dispersed to all parts of the mold cavity of the block being produced and can distribute an excess amount of material to areas of the mold as desired to achieve greater uniform density of material for the block thus making the blocks stronger and more durable.

BACKGROUND OF THE INVENTION

Numerous methods and materials exist for the construction of retaining walls and landscaping walls. Such methods include the use of natural stone, poured in place concrete, masonry, and landscape timbers or railroad ties. Segmental concrete retaining wall blocks which are dry stacked (i.e., built without the use of mortar) have become a widely accepted product for the construction of retaining walls. Such products have gained popularity because they are mass produced, and thus relatively inexpensive. They are structurally sound, easy and relatively inexpensive to install, and couple the durability of concrete with the attractiveness of various architectural finishes.

These wall blocks are generally produced in a mold assembly which usually consists of a mold box consisting of side frame and end frame walls forming an enclosed cavity, which rests on a production pallet or plate. The mold box assembly may contain one or multiple mold cavities which are configured to provide the block with a desired size and shape and thus may include the use of wall liners, cores and core bars, division plates, etc., as known in the art. A mixture or fill, generally of concrete material, is then poured or loaded into the mold cavities by a feed drawer that has received said material from a batching hopper. The feed drawer moves the fill over the top of the mold box assembly and dispenses the mixture into the mold cavities. As the fill is dispensed, a vibration system may be employed to shake the mold box assembly, thus providing compaction of the loose fill material to form a solid mold block. This vibration system functions to consolidate the concrete material within the mold cavities to produce a more homogeneous concrete product.

After the concrete is dispensed into the mold cavities, the feed drawer retracts rearward from over the top of the mold box assembly. Rigidly coupled on the front of the feedbox is generally a cut-off bar that strikes off and levels the mixture in the mold prior to compaction by the vibration function and stripper shoe compression head assembly producing a generally horizontal level surface. Since the cut-off bar is rigidly coupled to the feed drawer it must follow the generally horizontal path of the feed drawer. Blocks formed from the mold cavities have varying shapes and angles which may require the mix material to be distributed in different proportions from one mold cavity to another, so there is no weakening or compromising of the structural integrity and/or strength of the block from under-filling or over-filling of certain portions of the mold cavities. Since the cut-off bar follows the horizontal path of the feed drawer there is not a suitable means for distributing and leaving additional material in one portion of the mold cavity or less material in another portion of the mold cavity as may be necessary/optimal depending upon the shape and size of the block being produced. There is a need in the art for a cut-off bar that is not rigidly attached to the feed drawer and which can remove and/or redistribute varying amounts of material as necessary to all portions of the mold box cavity. This is most significant where the mold layout requires this varying distribution of material when critical elements, such as the moveable sideliners, are oriented perpendicular to the direction of travel of the feed drawer. If the mold cavities and moveable sideliners are aligned in parallel with the path of travel, then the rigid cut-off bar can be shaped to deposit the correct proportion of material over the area of need, but when the cavities are perpendicular to the feed drawer, there is currently no effective means to accomplish the correct distribution. Currently the methods used in the manufacturing process to aide in material distribution in the mold is to use an agitator grid (an element that sits over the mold box, but under the feed drawer, which functions to create general distribution of the mix material) or to isolate portions of the mold cavities from receiving a percentage of the mix material by use of blank-out plates added to the agitator grid. The blank-out plates are meant to starve some areas of the mold from receiving their full allotment of mix material, while allowing the other areas to receive the full amount. This currently is the known method of distributing material in a mold box.

Generally, after the cut-off bar and feed drawer have returned to their initial starting positions, the vibration cycle begins prior to the stripper shoe compression head, being lowered onto the consolidated material in the mold unit cavities of the mold box assembly. The stripper shoe assembly has plates or stripper shoes mounted to it having the same general plan view shape as the cavities in the mold. The plates may be set in a horizontal or angled orientation, depending on the desired shape for the top plane or surface of the block being made. The plates finalize the compression of the concrete material in the mold prior to pushing or stripping the block unit out of the mold in a downward motion. The stripper shoes are traditionally oriented parallel to the top plane of the mold (generally level or flat), but with some products they may be angled, or patterned in order to add a defined shape to the top surface of the block facing the stripper shoe plates.

The mold box assembly may be agitated to assist in compression of the mix material. Once the vibration cycle is complete, the production pallet is automatically lowered vertically away from the bottom of the mold frame during the de-molding or stripping cycle, and the newly molded block/blocks are pushed downward through the mold so that they remain on the manufacturing pallet in preparation of the next cycle of the manufacturing process were the blocks are sent to a kiln for a curing cycle. Accordingly, the desired shaped blocks can be readily removed from mold cavities.

In commonly assigned U.S. patent application Ser. No. 12/252,837, entitled "RETAINING WALL BLOCK", the entirety of which is incorporated herein by reference, a mold assembly for use in producing retaining wall blocks has a horizontal planar bottom member, a stripper shoe compression head (also referred to herein as a stripper shoe head assembly), a mold box having a plurality of side walls that define a plurality of mold cavities having open mold cavity tops and open mold cavity bottoms, the horizontal planar member enclosing the open mold cavity bottoms of the plurality of mold cavities and the stripper shoe head assembly enclosing the open mold cavity tops of the plurality of mold cavities during a block forming process. Each of the plurality of mold cavities can be shaped to form a single retaining wall block. Each of the plurality of mold cavities can be oriented such that the first side surface is formed at the bottom of the mold cavity and the second side surface is formed at the top of the mold cavity. One of the side walls of each of the plurality of mold cavities can be moveable from an inward block forming position to a retracted discharge position, the moveable sidewall having a three dimensional surface texture or pattern that imparts to the front face of the retaining wall block the three dimensional surface texture or pattern during the block forming process. The sidewalls of each of the plurality of mold cavities can include a forming channel to shape or form an extending flange or lip element which can be used as a means of connecting courses of the block in a retaining wall assembly, if the blocks are oriented with the flange in a downward position (extending downward past the bottom plane of the retaining wall block). The mold assembly further includes a core forming member which extends vertically into at least one of the plurality of mold cavities to provide the retaining wall block formed therein with a core extending from the first side surface to the second side surface, or can be partially formed from the first surface, but not all the way to the second surface. The core forming member can be configured to form a plurality of cores extending from the first side surface to the second side surface of the retaining wall block and the core or cores can have a variety of shapes, typically selected from round, oval, rectangular and square.

The stripper shoe head assembly includes a lower surface which encloses the open mold cavity tops as the stripping cycle is activated. The lower surface can be angled at an angle $\alpha$ with respect to horizontal such that the second side surface of the retaining wall block formed in each of the plurality of mold cavities during the block forming process forms angle $\alpha$ with respect to the front face of the retaining wall block, and wherein angle $\alpha$ is optimal between about 5° to 20°, or between about 7½° to 15°. Further, the sidewalls of each of the plurality of mold cavities can be shaped to form a vertically extending ridge that provides the retaining wall block with a flange receiving channel formed into a rear portion of the top surface and an upper portion of the rear face of the retaining wall block.

With current feed drawer and cut-off bar distribution techniques, the feed drawer generally distributes the same amount of material to the entirety of each mold cavity. The cut-off bar, which is rigidly coupled to the front of the feed drawer flows over the mold cavity in a horizontal path, with the feed drawer dropping and distributing the mix material as it travels. Once the feed drawer has reached its furthest forward motion point, it retracts along its original path where the cut-off bar now functions to screed or cut-off any excess material that was deposited over the open cavities of the mold, producing a generally level horizontal surface. Typically the mix material is screeded to allow an extra 0.375" to 1.0" of extra material over the block mold cavities. This material is the thickness calculated to compress during the vibration and compression cycle, such that the block will be formed in its consolidated state to a pre-determined height in the forming cavity. The stripper shoe head assembly with angled lower surfaces, descends and encloses the open mold cavities as it finalizes the compression of the material. As the stripper shoe head assembly with angled surfaces lowers to compress the material in the mold cavities, the density of the material is more compressed where the angled surface extends the furthest into the mold cavity and the density of the material is less compressed where the stripper shoe extends into the mold cavity the least. The result is that the block is stronger and denser where the material has been compressed more and is weaker and less dense where the material has been compressed less. This produces an uneven range of density along the gradient where the material was compressed by the stripper shoe head assembly, thus the structural integrity and strength of the block may be compromised which could additionally compromise the structural integrity and strength of any structure made from the blocks. In addition, where the block is over compressed, the material may expand (rebound) when released from the mold cavity and the planer surfaces may tear as a function of this rebound effect. Oppositely, areas in the mold cavity that have not received enough material may be less compressed and have unfilled, broken and crumbling surface areas or edge conditions.

Current feed drawer and cut-off bar distribution techniques do not allow for additional material to be distributed to an area of the mold cavity that may require additional material during compression. This situation arises, for example, in applications where a three-dimensional texture is being imparted onto a surface of the block in the mold cavity. Additional material to fill all crevices and structures of the texture being imprinted may be necessary during compression to ensure that the texture is compacted properly onto the moveable liner which creates the surface of the block being produced. The additional material that is needed where the three-dimensional texture is being imprinted is not needed for the rest of the area of the mold cavity and a material distribution technique that could distribute varying amounts of material throughout a mold cavity would save on material costs while ensuring that the block produced is structurally sound, stronger and more aesthetically pleasing to the eye upon proper imprinting of the texture.

Accordingly, there is a need in the art to correct deficiencies in the distribution of material in a mold box cavity and the amounts of compression within a mold box cavity and to achieve greater overall uniform density of material of the block thus making the blocks stronger and more durable as well as any structure built from the blocks.

SUMMARY OF THE INVENTION

The invention comprises a cut-off bar that is not rigidly attached to the feed drawer and that can remove and/or redistribute varying amounts of mix material as necessary to all portions of the mold box cavity for more precise and accurate control to enhance the structural strength and integrity of the block being produced and thus the structure being built with the block.

In one embodiment the invention is a cut-off bar that follows a preselected path of travel over a mold box during a block production cycle. The selected path of travel results in the distribution of desired and varying amounts of mix material in the mold cavity. The cut-off bar may be moveably attached to a feed drawer. The mold box may be provided with a member defining the selected path of travel. The member may comprise rails which define the selected path. The cut-off bar follows the angle or contour of the rails to distribute the desired and varying amounts of mix material in the mold cavity.

In another embodiment the invention is a block manufacturing assembly including a mold box having a member shaped to define a path of travel of a cut-off bar which moves over the mold box during a block production cycle to screed and distribute mix material in at least one mold cavity. The invention may include a feed drawer to which the cut-off bar may be moveably attached. The member which defines the path of travel of the cut-off bar may be a rail having an angled or contoured surface which defines the path of travel.

In a further embodiment the invention comprises a feed drawer having a cut-off bar moveably connected thereto. The invention may include a mold box and wherein the cut-off bar is configured to move over the mold box at varying heights during a block production cycle to screed or redistribute mix material in at least one mold cavity at depths which vary depending on the height of the cut-off bar above the mold box.

In another embodiment the invention is a method of manufacturing a block with the floating cut-off bar described herein.

In another embodiment the invention is a mold assembly for producing wall blocks that has a production pallet; a stripper shoe; and a mold box. The mold box has opposing side walls and opposing end walls which together form a perimeter of the mold box, the mold box also has an open top and an open bottom. The production pallet of the mold assembly encloses the open bottom of the mold box during a block forming process. The mold box also includes a spill pan that has first and second side walls and an end wall; the first and second side walls of the spill pan also have a control member. The mold assembly has a feed drawer configured to move during the block forming process from a first position vertically offset from the mold box to a second position above the mold box and back to the first position and to discharge block forming material into the mold box during the block forming process. The mold box assembly includes a material distribution element moveably connected to the feed drawer and configured to remove excess block forming material from the mold box or redistribute block forming material in the mold box as the feed drawer moves from the second position to the first position during the block forming process. The control member of the mold assembly is configured to control a path of travel of the material distribution element over the mold box as the feed drawer moves from the second position to the first position during the block forming process, with a height of the material distribution element above the production pallet changing as the material distribution element moves along the path of travel during the block forming process.

Additionally, the distribution element of the mold assembly may be a cut-off bar and the control member may have a first side rail mounted on the first side wall of the spill pan and a second side rail mounted on the second side wall of the spill pan. The control member also may have a non-linear top surface of both the first and second side walls of the spill pan, the non-linear top surfaces defining the path of travel of the material distribution element.

Further, the material removal element may have portions which abut the non-linear top surfaces of the first and second side walls of the spill pan as the material distribution element moves along the path of travel. The portions of the material removal element may also have first and second roller bearings. The material removal element may also include portions which abut the first and second side rails as the material distribution element moves along the path of travel and the portions may be first and second roller bearings. The material distribution element may be connected to be moveable with respect to the feed drawer from a downward position to an upward position, the material distribution element being biased to the downward position. The material distribution element may further be oriented parallel to the end walls of the mold box.

The end walls of the mold assembly may include first and second end walls and the path of travel of the material distribution element over the mold box may be from the first end wall to the second end wall. The stripper shoe of the mold assembly may have a lower surface configured to compress block forming material in the mold box during the block forming process, the lower surface being angled from horizontal at an angle $\alpha$, and the angle $\alpha$ may be in the range of about 5° to 20°.

In a further embodiment the invention is a method of producing wall blocks in a mold assembly which includes a production pallet, a mold box having an open top and an open bottom, a feed drawer and a stripper shoe. The method includes positioning the production pallet beneath the mold box to enclose the bottom of the mold box; moving the feed drawer from a first position which is vertically offset from the mold box to a second position above the mold box; and providing a spill pan having first and second side walls, the first and second side walls including a control member. The method also includes depositing block forming material from the feed drawer into the mold box; and moving the feed drawer from the second position back to the first position. The method further includes that after the block forming material has been deposited in the mold box and the block forming material has been redistributed within the mold box such that a height of block forming material above the production pallet in a first portion of the mold box is greater than a height of block forming material above the production pallet in a second portion of the mold box, and the first and second portions of the mold box has a location such that a line which intersects both the first and second portions is parallel with a direction of travel of the feed drawer as it moves from the second position back to the first position, then the stripper shoe is lowered to enclose the open top of the mold box and to compress the block forming material within the mold box and the block forming material is removed from the mold box.

The method of producing blocks in a mold assembly may further include that the step of redistributing the block forming material in the mold box is performed by moving a material distribution element over the mold box along a path of travel defined by the control member from a first end of the mold box to a second end of the mold box, a height of the material distribution element above the production pallet over the first portion of the mold box being greater than a height of the material distribution element above the production pallet over the second portion of the mold box. The method may also include that the material distribution element is moveably connected to the feed drawer and wherein the redistributing step is performed when the feed drawer is moved from the second position back to the first position.

Additionally the method may include that the control member is configured to control the height of the material distribution element above the production pallet as the material distribution element moves along the path of travel and that the control member may have a first side rail mounted on the first side wall of the spill pan and a second side rail mounted on the second side wall of the spill pan.

The control member may also have a non-linear top surface of both the first and second side walls of the spill pan, the non-linear top surfaces defining the path of travel of the material distribution element.

Further, the method of producing blocks in a mold assembly may include that the material removal element has portions which abut the non-linear top surfaces of the first and second side walls of the spill pan as the material distribution element moves along the path of travel and that the portions of the material removal element may have first and second roller bearings. Additionally, the material removal element may have portions which abut the first and second side rails as the material distribution element moves along the path of travel and the portions of the material removal element may include first and second roller bearings.

BRIEF DESCRIPTION OF THE DRAWINGS

The invention is described with reference to the following drawings. It should be noted that for purposes of clarity and to better show features of the invention certain parts or portions of structure have been removed in various drawing figures.

DETAILED DESCRIPTION OF PREFERRED EMBODIMENTS

The blocks produced from this invention may be made of a rugged, weather resistant material, such as concrete. Other suitable materials include plastic, fiberglass, composite materials, steel, other metals and any other materials suitable for use in molding wall blocks. The surface of the blocks may be smooth or may have a roughened appearance, such as that of natural stone. The blocks are formed in a mold and various textures can be formed on the surface, as is known in the art. It should be appreciated that the invention is equally applicable to blocks of all sizes including those whose faces are either larger or smaller than the ones referenced herein In accordance with an embodiment of the present invention retaining wall blocks are formed in mold box assemblies as described below. The mold box assemblies have multiple mold cavities and the blocks are formed with a first side surface resting on the production pallet and the second side surface oriented at the top of the open mold cavity. This orientation of the blocks takes up less space on the production pallet than if the blocks were oriented in a mold with their top surface on the production pallet. Thus, the number of mold cavities in the mold box can be increased so that a greater number of blocks can be made in a production cycle on a production pallet. It should be noted that the present invention is applicable to any mold box and the block or blocks formed therein may have any block shape and may have any surface shape or contour oriented to the top of the mold cavity.

Figure 1A:
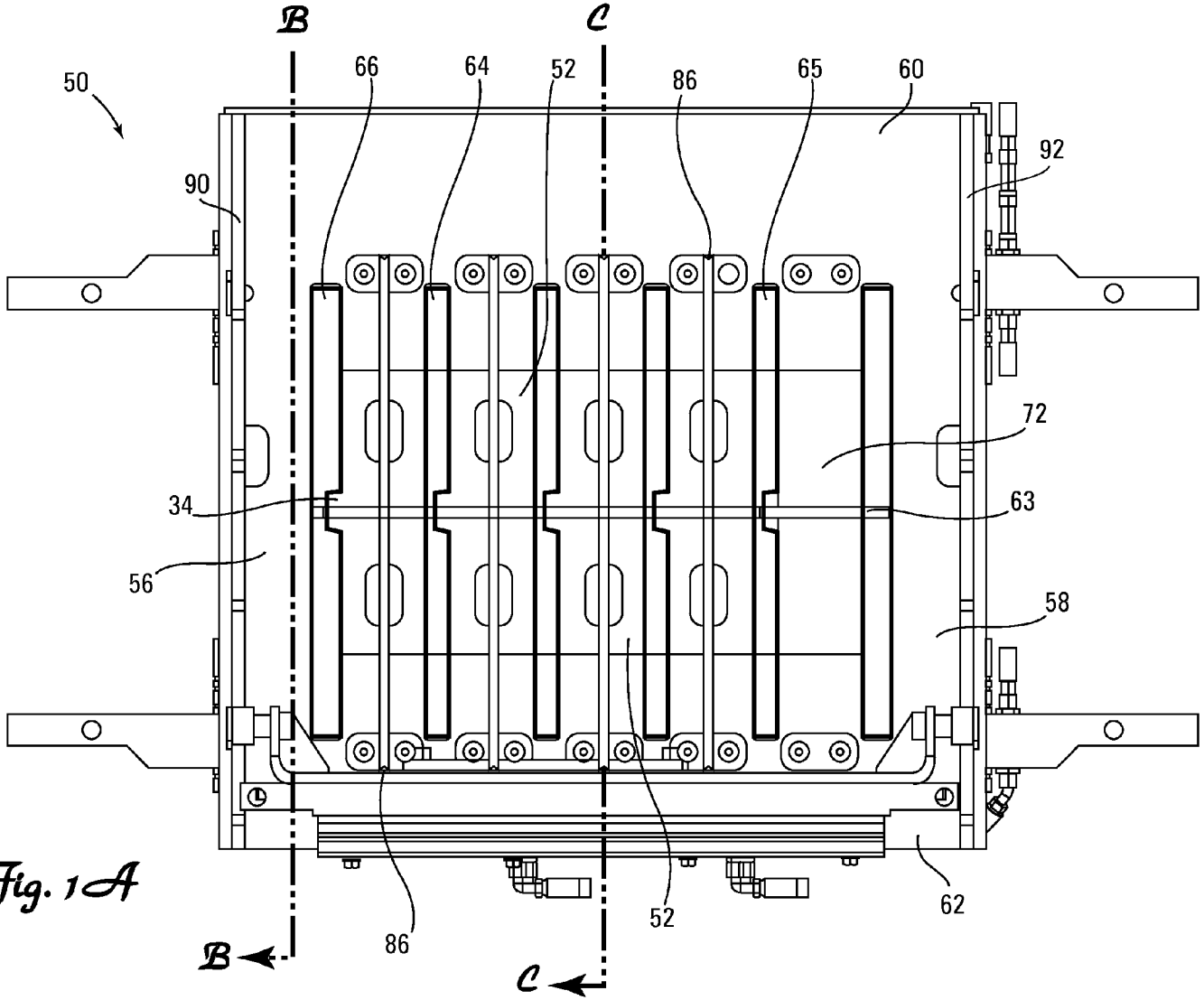
FIGS. 1A and 1B are top and perspective views, respectively, of a mold box of the present invention.
Figure 1B:
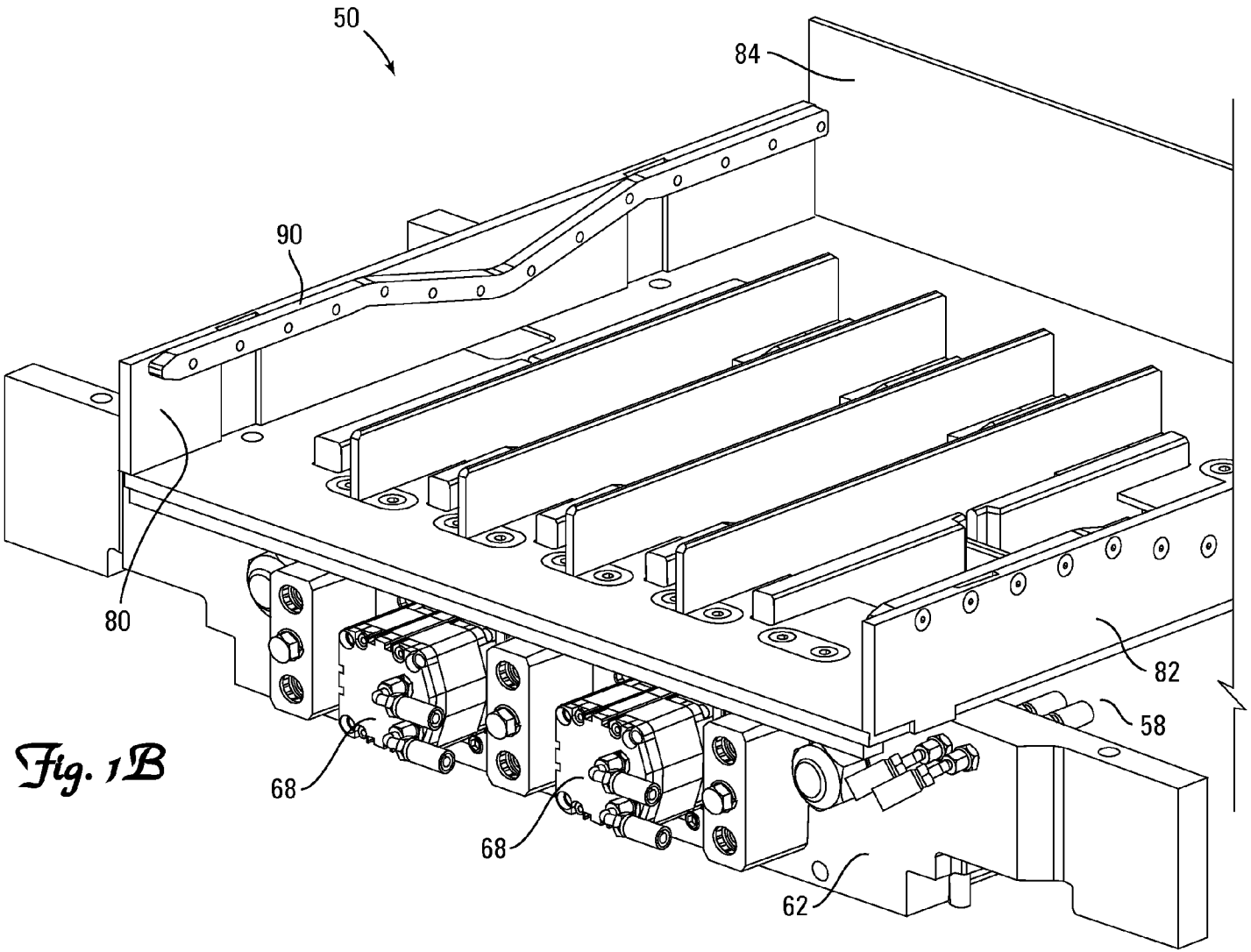
Figure 1C:
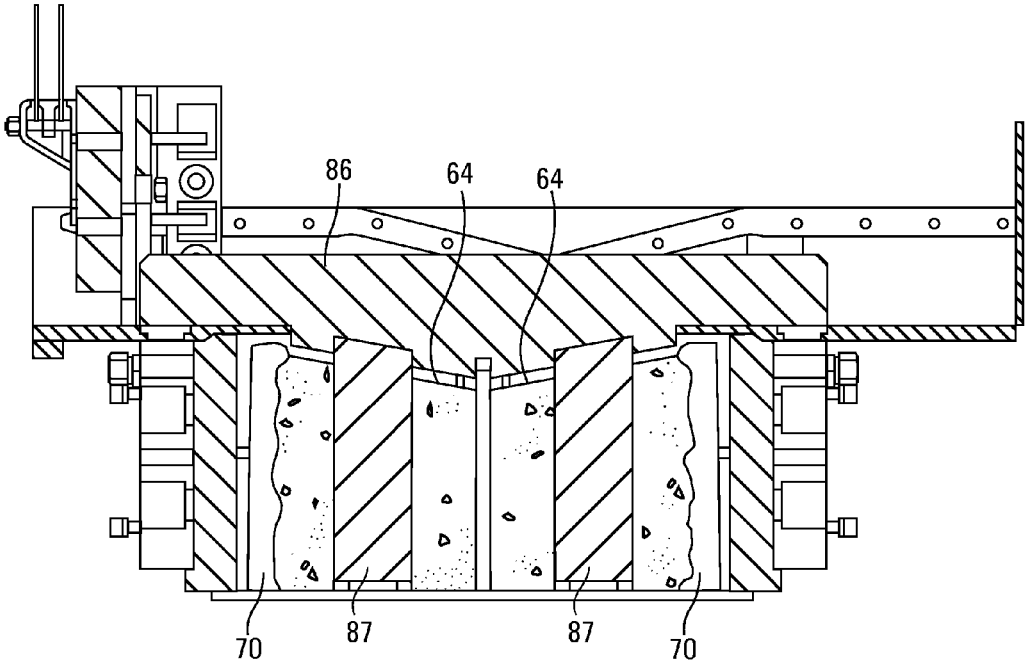
FIG. 1C is a cross sectional view of the mold box along line C-C of FIG. 1A.

FIG. 1A is a top view and FIG. 1B is a front perspective view, respectively of a mold box 50. FIG. 1C is a cross sectional view of mold box 50. Mold box 50 includes ten mold cavities consisting of eight primary retaining wall block cavities 52 and two corner block cavities 72, that are used in combination to form a retaining wall, thereby producing 10 wall blocks in a production cycle on a production pallet. Blocks of different sizes can be made in mold box 50. By way of example, the blocks formed in mold box 50 may have a height (as manufactured in the bold box) of 8 or 12 inches depending on the height of the mold cavities above the production pallet, a width (as manufactured in the mold box) of 4 inches, and a depth of 7 inches. Mold box 50 is configured and sized for use with a typical production pallet, which may have a size of 18.5 inches by 26 inches. It should be noted that the size of the production pallet is not limiting and any varying size and shape of blocks may be produced according to the application as needed. It should also be noted that the present invention is applicable to any size mold box used to form a single or multiple blocks during a production cycle.

Mold box 50 generally includes spill pan side walls 80 and 82 and spill pan end wall 84. Mold box 50 also includes opposing first and second side frame walls 56 and 58 and opposing first and second end frame walls 60 and 62.

Mold cavities 52 (eight cavities in mold box 50 as shown in FIG. 1A) are formed by angled division plates 64 and/or side division plate 65, and/or end liners 66 that form the sides walls of the mold cavity, which along with moveable side liners 70 and center division plate 63 that form the end walls of the mold cavity, define a plurality of mold cavities having open mold cavity tops and open mold cavity bottoms. The division plates and end liners are attached to frame walls 56, 58, 60 and 62 of the mold box in a known manner. Though rigidly attached, the division plates are installed in such a way as to be replaceable when they reach a designated degree of wear. Division plates 64 and 65 are of two different shapes. Division plate 65 has substantially parallel top and bottom surfaces, while division plate 64 has an angular sloping top shape. FIG. 1C illustrates an elevation view showing the angled shape of division plates 64 as they sit in the mold. The angle and contour of the division plates may mimic or duplicate a precise, predetermined and controlled material distribution pattern that side rails 90 and 92, attached to spill pan side walls, employ for a floating cut-off bar to follow as a feed drawer moves forward and backward as it travels its path over the mold box to deliver and screed off the mix material. As the feed drawer returns over the mold to its start position, any excess material that exists over the predetermined compaction height (approximate 0.375 of an inch to 1.0 inch) will be screeded off the top by the floating cut-off bar and the excess material will be allowed to flow back into the feed drawer. It should be noted that this pattern is not limiting and any pattern could be given to side rails and the division plate or plates for the production of different sizes and shapes of blocks and material distribution patterns depending upon the application and the desired shape of the blocks formed in the mold box. It should be further noted that the division plate need not have the angled or contoured pattern as that of the side rails and could have substantially parallel top and bottom surfaces.

Mold cavities 72 (two cavities in mold box 50 as shown in FIG. 1A) are formed from division plate 65 and end liner 66 that form side walls of the mold cavity, which, along with moveable impression face liners 70 and central division plate 63 that form the end walls of the mold, define a plurality of mold cavities having open mold cavity tops and open mold cavity bottoms. Division plates 64 and 65 are of two different shapes. As previously noted division plate 65 has substantially parallel top and bottom surfaces and is used for producing mold cavity 72 which produces the corner blocks of the present invention.

Figure 1D:
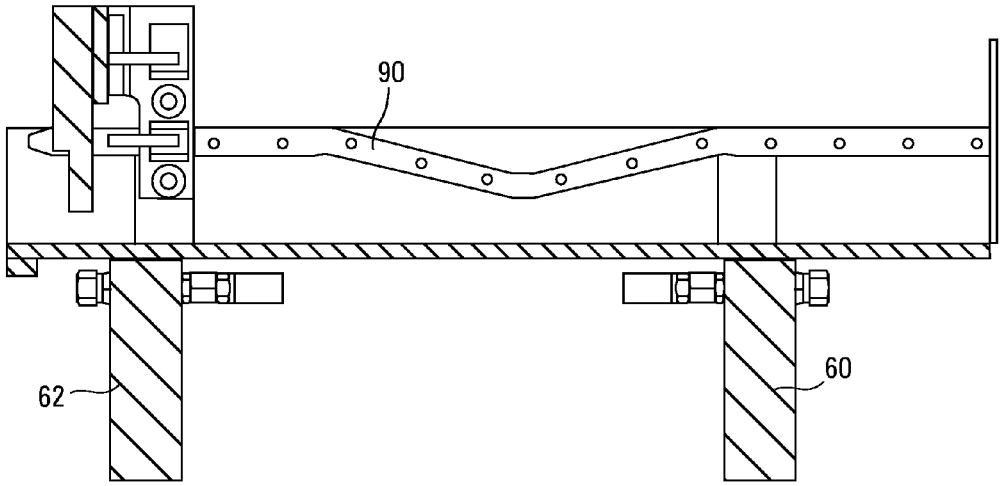
FIG. 1D is a cross sectional view of the mold box along line B-B of FIG. 1A.

Spill pan side wall 80 has track or side rail 90 mounted thereto and spill pan side wall 82 has side rail 92 mounted thereto. Side rails 90 and 92 can be made of any appropriate material which is strong and durable and can withstand the pressures and wear to which the rails will be subjected during repetitive block production cycles. Side rails 90 and 92 can be fastened to the side walls through welding, bolting, screwing, etc. Side rails 90 and 92 have a predetermined and precise contoured path along the length of both spill pan side walls 80 and 82. The angular pattern of side rails 90 and 92 form a precise and controlled material distribution pattern that a floating cut-off bar will follow as a feed drawer advances and retracts over the mold box during material distribution. The angular pattern of side rail 90 (which is the mirror image of side rail 92) can be seen in FIG. 1D. As the feed drawer retracts any excess material may be screeded by the cut-off bar and re-distributed to areas as needed in the mold cavity as discussed further below. More specifically, the distribution pattern of the side rails and optionally the angled division plate is to meter out a correct and specific proportion of material to fill the mold cavities and to also add additional material as necessary in specific areas of the mold cavity to infill increased void space of the stone shaped texture (or any shaped texture) of the movable liners (or any other three-dimensional liners) employed by the mold cavity. The three-dimensional pattern/texture on the movable liners (or other liners) are the negative image or pattern of the imparted texture that is applied to the mold cavity when filled with material and compacted and thereby leaves a positive image or pattern (convex) on the unit or block being produced. It should be noted that the contour and pattern of the side rails are not limiting and any contour or pattern could be given to rails 90 and 92 for the production of different sizes, shapes and textures of blocks in different mold boxes depending upon the application.

Each of the mold cavities have a vertical flange forming channel 34 formed by the division plate in the cavities that produce the side walls extending from the top of the mold box to the bottom and which form a flange on each block. Blocks may be formed with cores. The cores are produced by typically hollow forms 87 used to create vertical voids or cavities in the blocks and which are attached to the core bars 86, which span the side frame walls and support the core forms in the blocks produced in the mold cavities. This is done in accordance with known techniques. Mold box 50 also includes moveable side liner mechanisms 68 which are attached to movable side liners 70. During the block production cycle the movable side liners are positioned in a first inward or block forming position when the mold cavities are filled with moldable material. The side liners 70 may be created with any desired three dimensional texture or pattern and impart to the front face 12 of the retaining wall blocks any desired three dimensional texture or pattern when in this first position. When the blocks have been formed and are ready to be discharged from the mold cavities, moveable side liners 70 are moved to a second retracted or discharge position. In the retracted position the side liners are spaced from the front face of the blocks far enough to allow the blocks to be discharged from the mold cavities without interference from the side liners. It should be understood that the mold box is not limiting and variations and alternate embodiments may be used as desired. It should be further understood that a plurality, but not all, of the mold cavities may have moveable side liner mechanisms or none of the mold cavities may contain the movable side liner mechanisms.

Figure 2A:
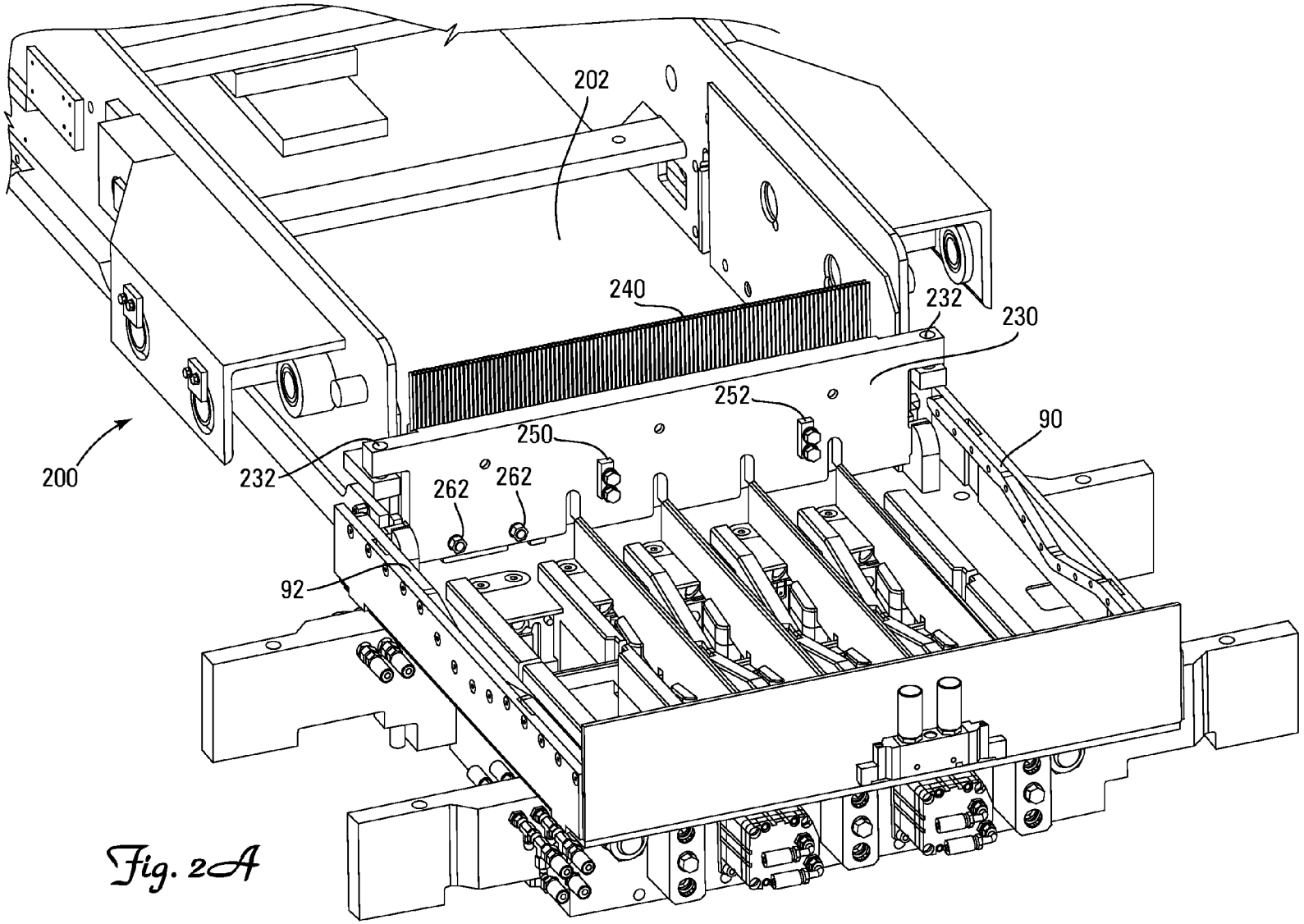
FIG. 2A is a front perspective view of a feed drawer assembly and mold box.

FIG. 2A illustrates a feed drawer assembly 200 with mold box 50 in a resting position under a mix hopper 400 (not shown in FIG. 2A, see FIGS. 6A to 6H). In FIG. 2A the floating cut-off bar of the present invention which is described in detail hereafter is removed to better show certain features of the invention. Feed drawer assembly 200 includes a feed drawer 202 which is open at the top to receive material from the mix hopper and the bottom to dispense the material received from the mix hopper into the mold cavities as the feed drawer passes over the top of mold box 50. Feed drawer 202 has a feed drawer drive mechanism, as known in the art, which is operable for moving the feed drawer 202 from a first retracted or resting position to a second extended position with the open bottom of the feed drawer in communication with the open top of the mold box 50 and back to the retracted or resting position again.

Figure 2B:
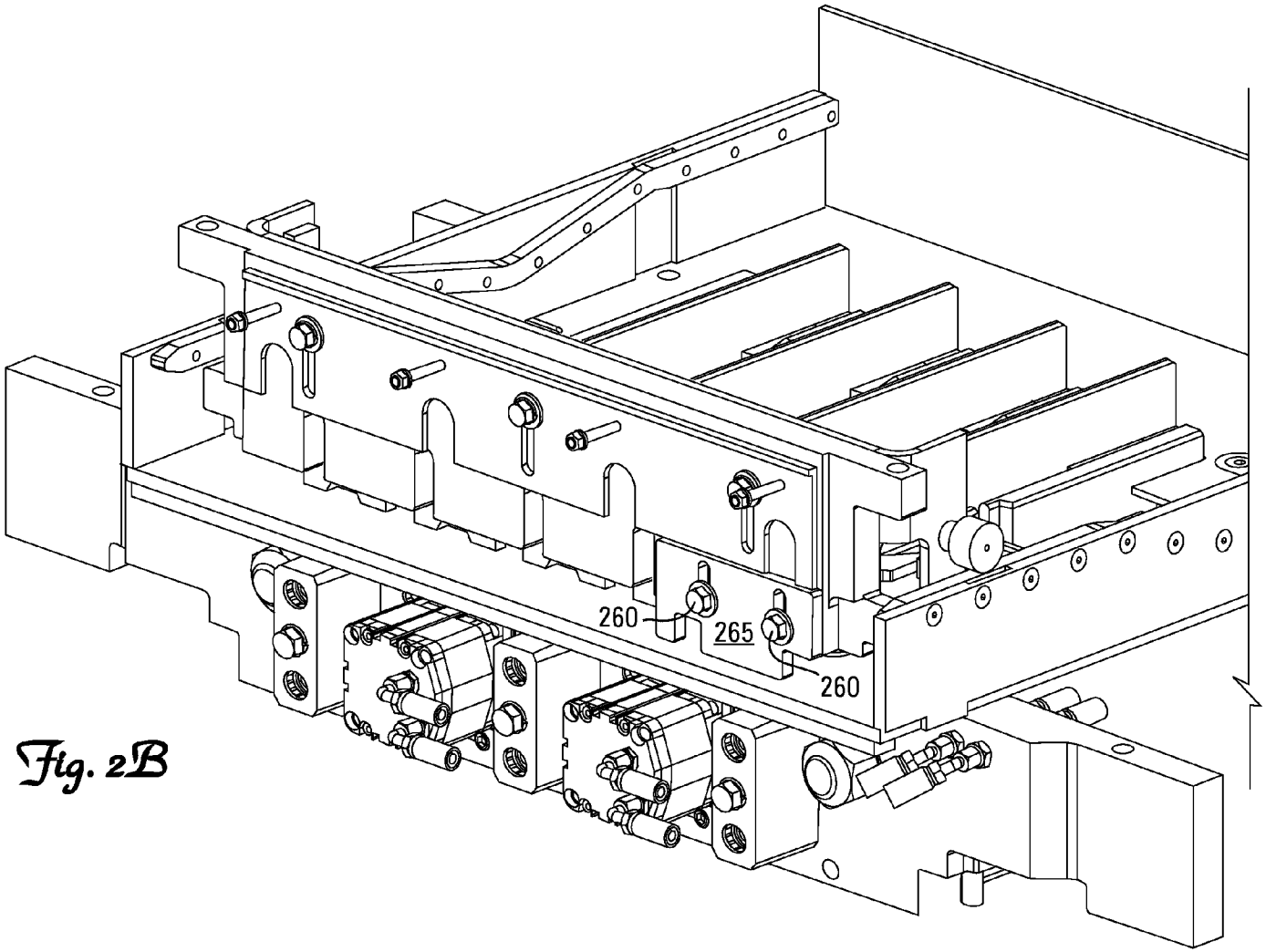
FIG. 2B is a back perspective view of an end panel of the feed drawer over the mold box of FIG. 2A.

Feed drawer 202 has end panel 230 which is rigidly connected to feed drawer 202 by fasteners 232 which may consist of bolts or the like. Brush 240 is also attached to end panel 230 and may be adjusted for height depending upon the application. Brush 240 cleans off waste material lodged or stuck to stripper shoes coupled to a head plate assembly by means of connecting plungers as known in the art. The cleaning occurs as the brush, as attached to the feed drawer passes back and forth under the stripper shoe head assembly while the material is distributed to the mold cavities of the mold box assembly. The brush engages the bottom surfaces of the stripper shoes and dislodges and sweeps any waste material that may have been left from previous production cycles. End panel 230 also contains bolt mounting points 250 and 252 which can be used to mount a floating cutoff bar to the feedbox assembly 202 as discussed further below. Bolts 260 secured to nuts 262, attach screed plate 265 to the back surface of end panel 230 as shown in FIG. 2B. Screed plate 265 is located inside feed drawer 202 and functions as a fixed cut-off bar to screed excess material back into the feed drawer as the feed drawer retracts from its extended position after material distribution to mold cavities 72 back to its original resting or starting position.

Figure 3A:
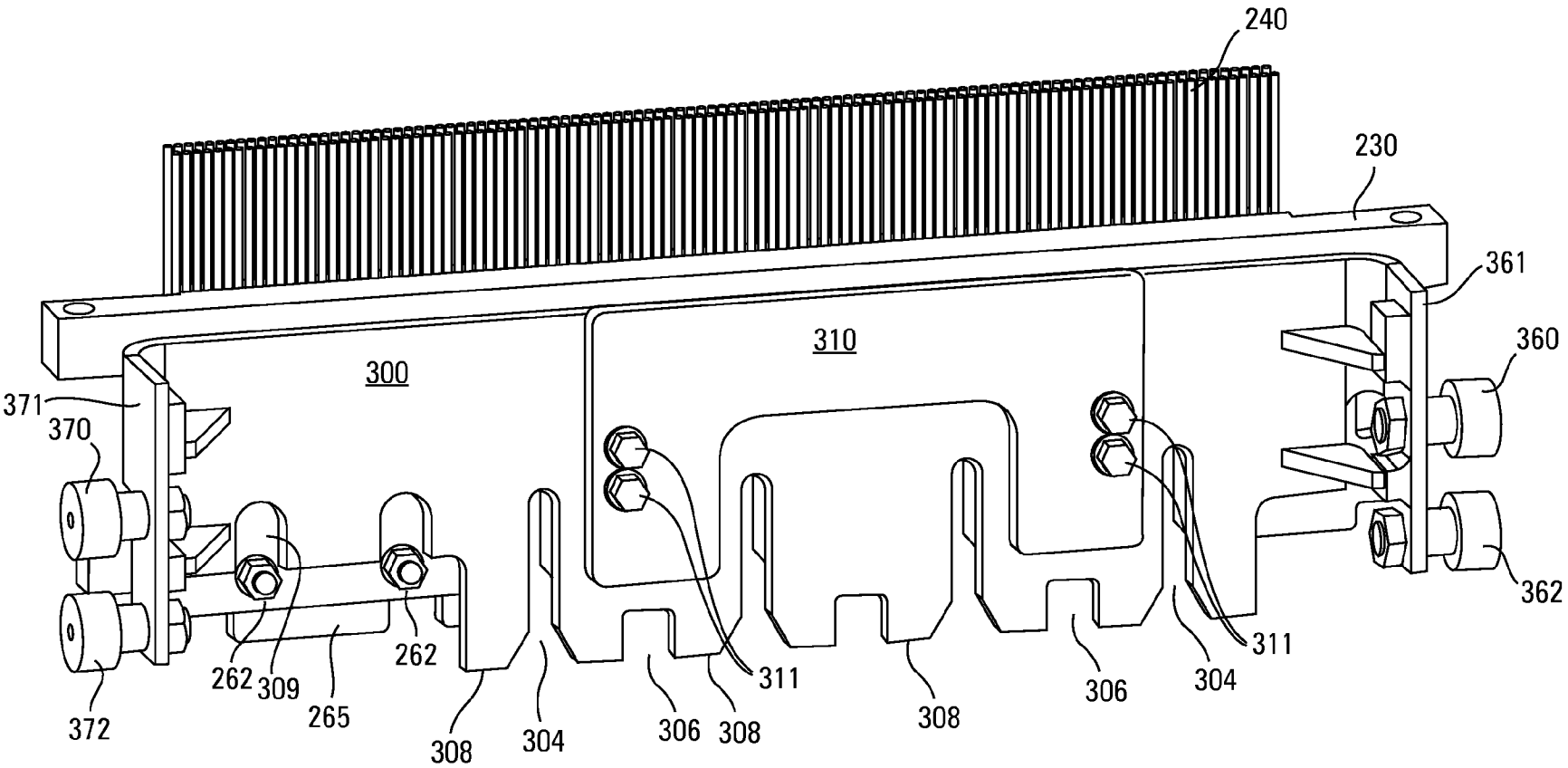
FIG. 3A is a perspective view of a floating cut-off bar of the present invention.
Figure 3B:
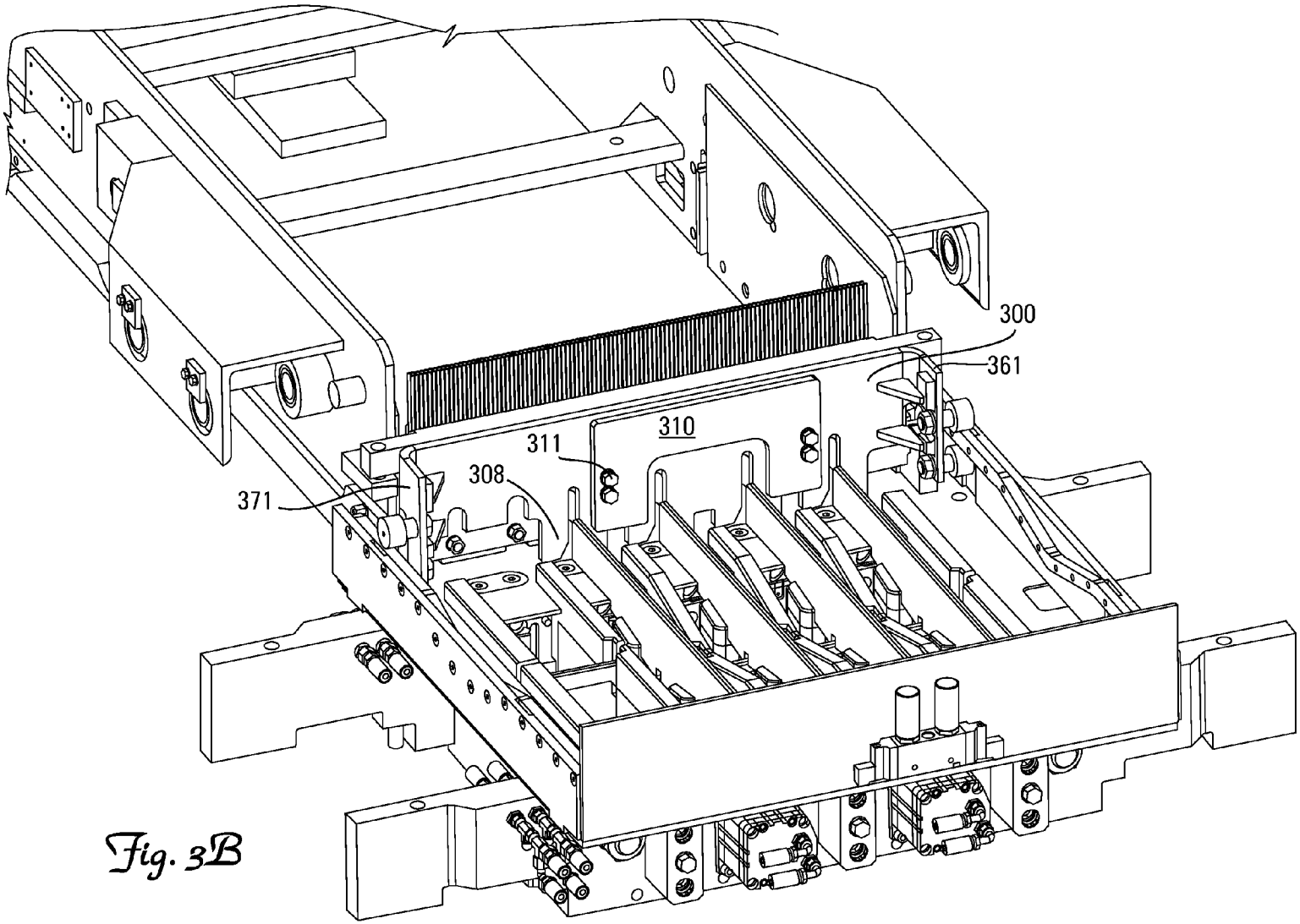
FIGS. 3B and 3C are perspective views of the floating cut-off bar of FIG. 3A with the feed drawer assembly and mold box of FIG. 2A.
Figure 3C:
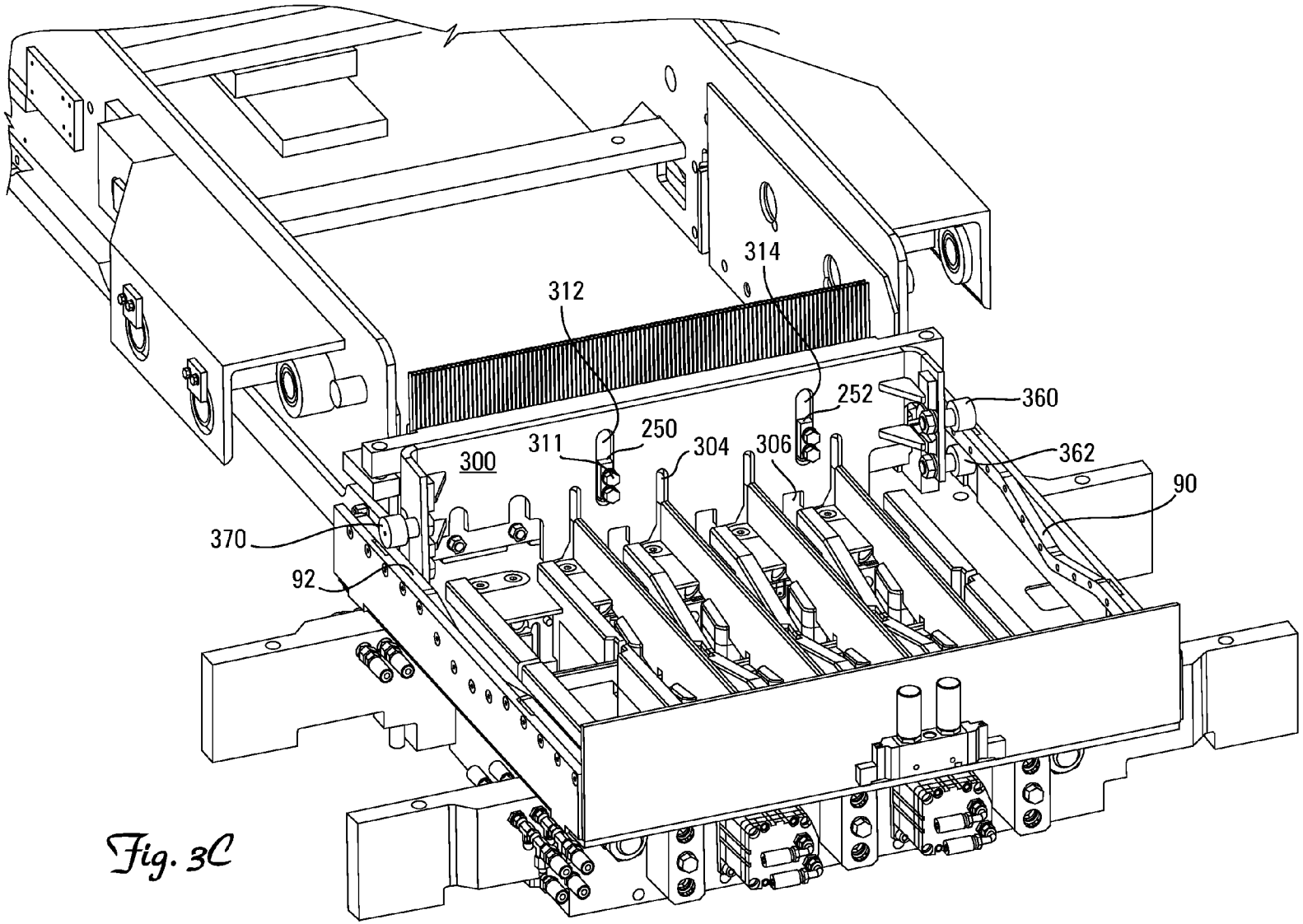

FIG. 3A is a front perspective view of a floating cut-off bar 300 of the present invention slideably attached to end panel 230. In FIG. 3A end panel 230 is shown detached from the remainder of the feed drawer in order to better show the floating cut-off bar and its manner of slideably attachment. FIGS. 3B and 3C are front perspective views of the floating cut-off bar of FIG. 3A and end panel 230 attached to feed drawer 202 and positioned over mold box 50. Floating cut-off bar 300 has core bar slots 304 that allow the floating cut-off bar to fit over core bars 86 of mold box 50 with additional space to allow for the up and down movement of the floating cut-off bar as it travels the entire horizontal path of the feed drawer 202 from the resting or first position to the second extended position back to the resting position and additionally as the floating cut-off bar vertically moves with the angular pattern of side rails 90 and 92, which may also be the angular pattern of division plates 64 of mold box 50. Notches 306 allow the floating cut-off bar to ride over the vertical angular division plates 64 and may be sized so that notches 306 are in contact with the top surfaces of division plates 64 to screed away any left over material on the top surface of the division plates after material distribution has occurred or may be sized so that there is some distance between the top surface of the division plate and the notch. It should be noted that angular division plates need not have the same distribution pattern as the side rails and may in fact be substantially horizontal. If the angular division plate is substantially horizontal, notches 306 would just be sized larger to allow for the vertical range of movement of the floating cut-off bar along the material distribution path of the side rails.

As floating cut-off bar 300 retracts from the second extended position after material has been distributed to the mold cavities along the path of side rails 90 and 92, tabs 308 descend into mold cavities 52 of mold box 50 a predetermined distance and screed excess material back into feed drawer 202 or redistribute material to areas that do not contain the sufficient amount of material. Slots 309 allow the cut-off bar to have a vertical range of motion that will not be interfered with or hindered by nuts 262 and bolts 260 of screed plate 265. Bolts 311 secured to mounting points 250 and 252 of end panel 230 of feed drawer 202 protrude through mounting slots 312 and 314 of floating cut-off bar 300 and are coupled to mounting bracket 310. Because mounting bracket 310 is directly coupled to end panel 230 and because floating cut-off bar 300 is housed and loosely connected but not fixedly attached between the mounting bracket and the end panel by bolts 311, mounting slots 312 and 314 allow a predetermined range of vertical movement as the feed drawer follows the path of side rails 90 and 92 when the feed drawer extends and retracts during the production cycle. Mounting bracket 310 is shown attached to end panel 230 in FIGS. 3A and 3B and removed in FIG. 3C to better show this feature.

FIG. 3A illustrates side rollers 360, 362, 370 and 372 of floating cut-off bar 300. Side rollers 360, 362 are attached to bracket 361 and side rollers 370 and 372 are attached to bracket 371 by bolts or other suitable means of attachment. Brackets 361 and 371 are coupled to the floating cut-off bar through welding or other attachment means. As the feed drawer drive mechanism extends the feed drawer and floating cut-off bar from the resting position to an expanded material distributing position the side rollers 360 and 362 of the floating cut-off bar ride above and below the spill pan side rail 90 of mold box 50 and side rollers 370 and 372 of the floating cut-off bar ride above and below the spill pan side rail 92 of mold box 50. The predetermined contoured path the side rollers follow on the spill pan side rails allows the floating cut-off bar to vertically move up and down as the feed drawer is expanded and material is distributed to the mold box due to the vertical mobility granted to the floating cut-off bar because of the mounting slots 312 and 314, notches 306 and core bar slots 304. Once the material has been distributed by feed drawer 202 the feed drawer drive mechanism retracts the feed drawer and floating cut-off bar and the side rollers of the floating cut-off bar follow the same path of the spill pan side rails back to the original or resting position. Side rails 90 and 92 and optionally the angled division plates 64 have a calculated precise pattern for the floating cut-off bar to follow for optimal material distribution and/or redistribution to the mold cavity. This optimal distribution allows for maximum control of the produced block's structural strength and integrity, and thus a structure's structural strength and integrity produced from such a block. It should be noted that the contoured path of the spill pan side rails that the floating cut-off bar follows is provided as an example and is not limiting and could have any contoured shape as differing block specifications require.

Screed plate 265 is placed in a specified location on end panel 230 of feed drawer 202 to allow the screeding of mix material to a certain predetermined depth of mold cavities 72 of mold box 50. Screed plate 265 ensures that the pre-determined number of the blocks formed in the mold cavities 72 of mold box 50 have level and horizontal surfaces as the screed plate travels the path of the feed drawer. Floating cut-off bar 300 allows a predetermined number of blocks formed in the mold cavities 52 of the mold box to have an angular surface as the floating cut-off bar travels the path of the feed drawer as dictated by the design of the side rails of the spill pan. The combination of floating cut-off bar and screed plate attached to the feed drawer allows for the production of two different types/styles/shapes of blocks in a mold box production cycle. It should be noted that the combination and relative sizes of the floating cut-off bar with screed plate is not limiting and differing sizes of cut-off bar and screed plate may be employed. It should be further noted that a single floating cut-off bar could be used along the entire length of the end panel of the feed drawer to encompass all mold cavities in a mold box.

Figure 4:
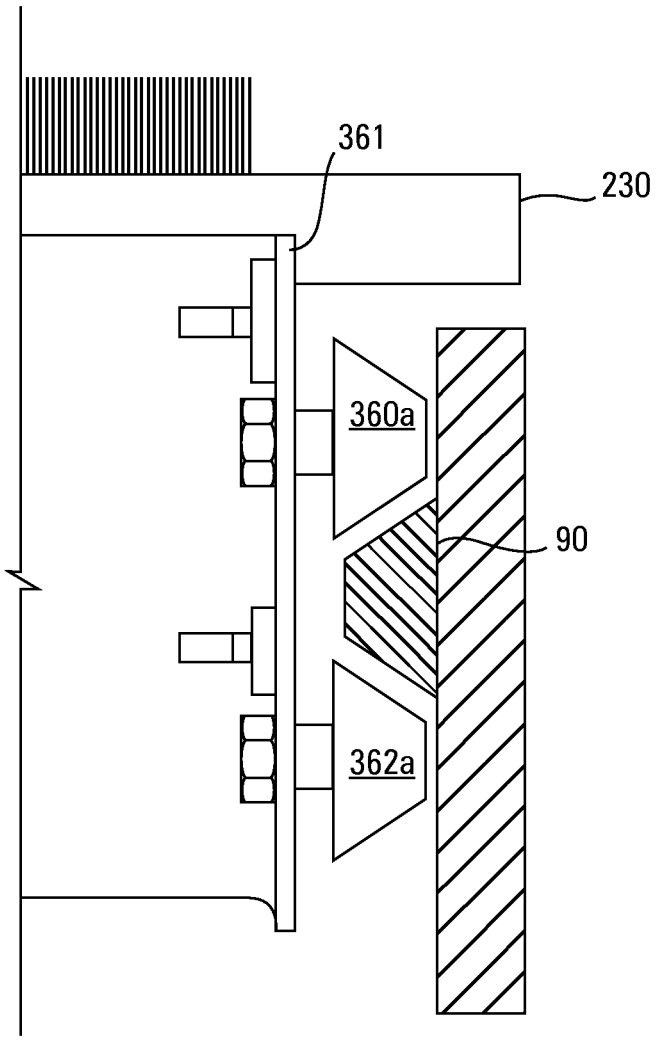
FIG. 4 is a front view of a different embodiment of side rollers of the floating cut-off bar of the present invention.

FIG. 4 illustrates a different embodiment of the side roller and side rail feature of the present invention. Angled side rollers 360*a* and 362*a* ride along angled side rail 90. The angle of the top surface of spill pan side tracks 90*a* declines at an angle relative to horizontal, in a range from 0° to 30° and more preferably from 5° to 30° and this angle is the inverse of that of the side roller 360*a* which inclines at an angle in a range from 0° to 30° and more preferably from 5° to 30° relative to horizontal. The angle of the bottom surface of spill pan side tracks 90*a* inclines at an angle relative to horizontal, in the ranges as listed above and this angle is the inverse of that of the side roller 362*a* which declines at an angle, in the ranges as listed above relative to horizontal. These angles help safeguard against excess material becoming lodged in the tracks and side rollers during material distribution providing durability to the production cycle of the blocks being formed. It should be noted that the side rails or tracks and the rollers which ride over them could have a variety of different shapes and sizes within the scope of the present invention. It should further be noted that only the top surface of the side rails may be angled and thus the side roller 362*a* need not be angled as desired depending upon the application.

Figure 5:
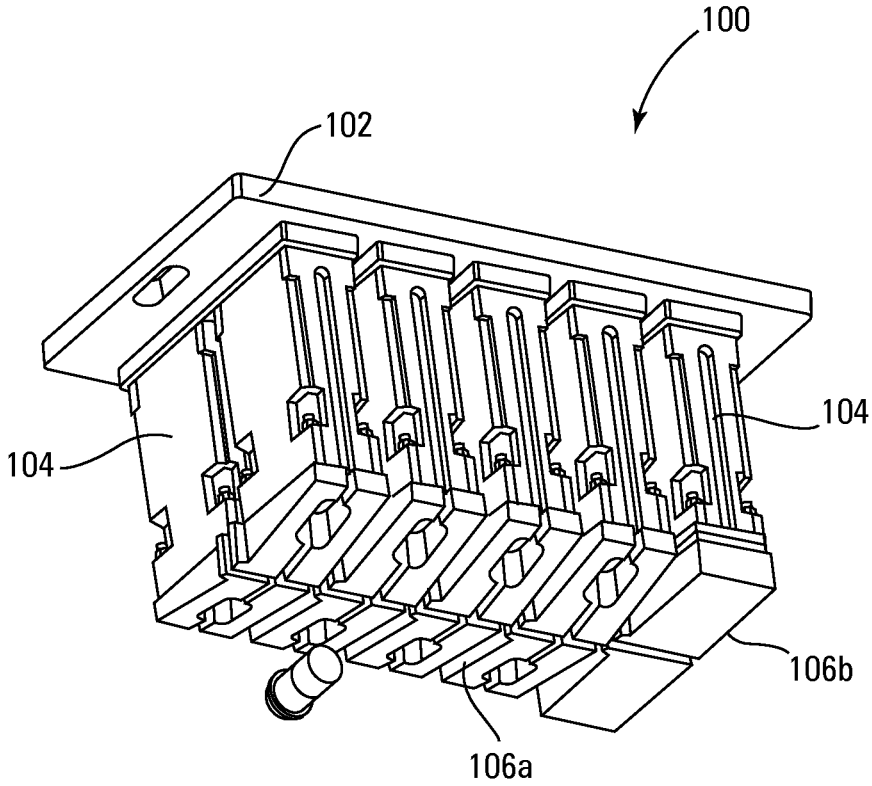
FIG. 5 is a perspective view of a stripper shoe head assembly of the present invention.

FIG. 5 is a bottom perspective view of a stripper shoe head assembly 100 in accordance with one embodiment of the present invention. Stripper shoe head assembly 100 includes a head plate 102 and stripper shoes 106*a* and 106*b*. A plurality of plungers 104 are attached between the head plate 102 and the upper portion of the stripper shoe 106*a/b*. Optional shoe components used for molding embossed or debossed shapes onto the top of block surface (not shown) may be received within compatible openings in the bottom of the stripper shoe 106*a/b* depending upon the application. The compression head has plates or stripper shoes that have the same shape as the cavities in the mold, and are used to compact the material in the mold cavities to specific densities and to aid in discharging the blocks from the mold cavities when the production cycle is complete. Typically, a lower surface of the compression head which contacts the block at the top of the open mold cavity lies in a generally horizontal plane. In accordance with the present invention the surface of the stripper shoe which contacts the second side surface of the retaining wall block at the top of the open mold cavity may be either horizontal as stripper shoe 106*b* to create a first type block corresponding to mold cavities 72 which may be a generally rectangular corner block; or may be angled as stripper shoe 106*a* to create a second type block corresponding to mold cavities 52, the angled surface imparting to the second side surface the angle α which may be in the range of 5° to 20°, or between about 7½° to 15°, but it should be noted the angle is not limiting and any angle could be achieved relative to the desired angle of the surface of the block being produced.

The surfaces of the stripper shoes 106*a/b* which contact the moldable material at the open top of the mold cavity forming the second side surface of the block may be textured or patterned to impart on the second side surface any desired three dimensional texture or pattern. Mold box 50 such as shown in FIGS. 1A and 1B having mold cavities which are configured to form both corner blocks and regular wall blocks with an angled side surface is useful since it requires only one mold box and one mold cycle to produce both types of blocks. It should be understood, however, that mold box 50 may be configured so that corner blocks 72 are formed in one or more mold cavities at any desired location of the mold box. Further, it is possible to configure the mold box so that all of the mold cavities are used to form corner blocks or that all of the mold cavities are used to form regular wall blocks or any desired combination thereof.

Figure 6A:
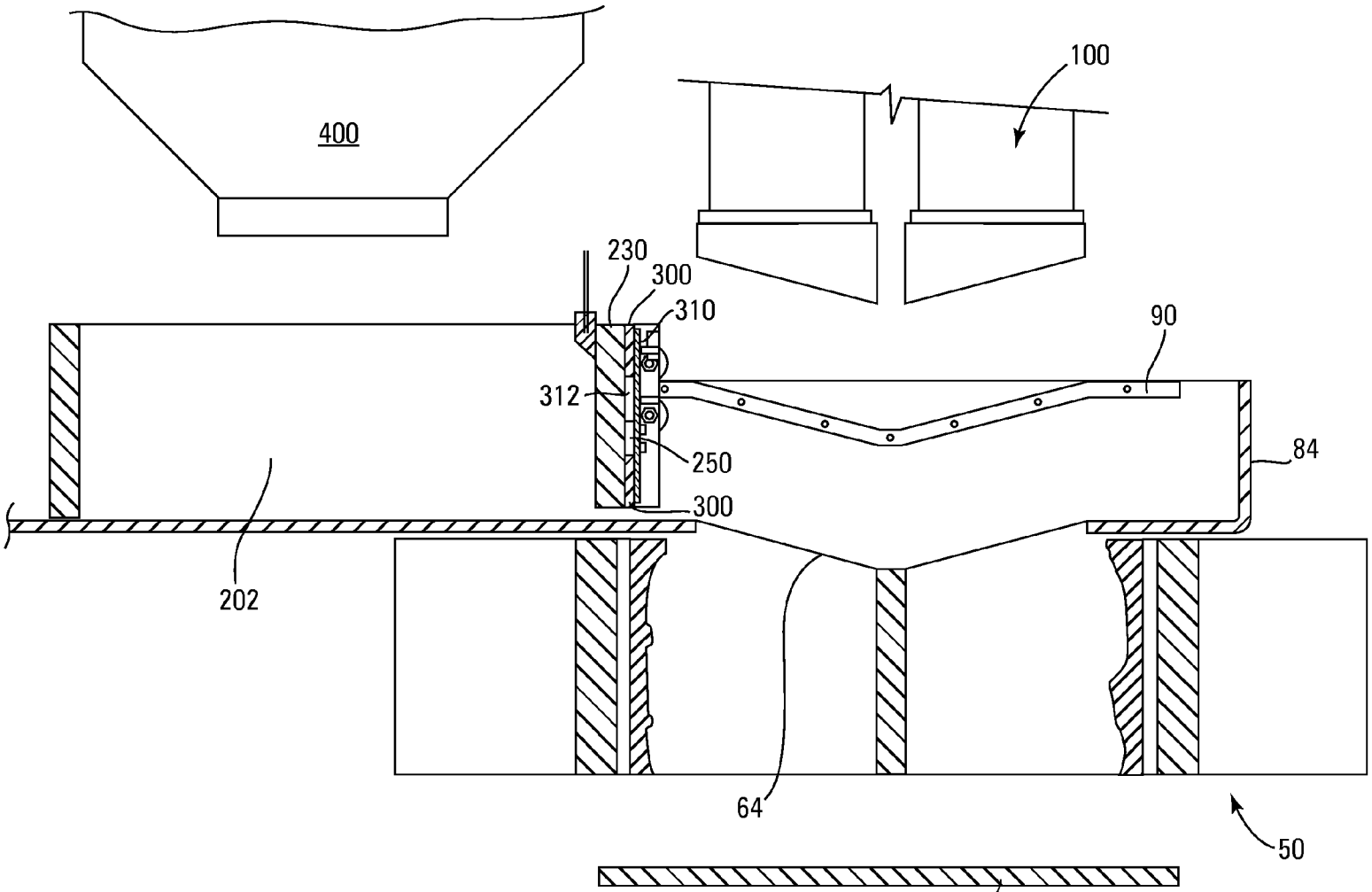
FIGS. 6A to 6H are cross-sectional views of a material delivery hopper, feed drawer, floating cut-off bar, mold box, mold cavity, moveable liner plate with 3-dimensional texture, stripper shoe head assembly and manufacturing pallet demonstrating a variety of typical function positions during a mold production cycle of the present invention.

FIGS. 6A to 6H illustrate in cross sectional views relative to the feed drawer 202 and mold box 50, and specifically illustrating mold cavity 52 with angled division plates 64, of a block production cycle of the present invention. Side rail 90 is shown in FIGS. 6A to 6H to better illustrate the progression and path of the floating cut-off bar during the production cycle. The cross sectional view of the floating cut off bar is taken at mounting slot 312 to show the vertical movement of the floating cut-off as it expands and retracts over rail 90. FIG. 6A shows feed drawer 202 in a resting or retracted position sitting directly beneath the mix hopper 400 ready to be filled with material and the stripper shoe head assembly 100, located above the mold box is in its initial retracted starting position. Mounting point 250 of the end panel 230 of the feed drawer 202 is located near the bottom of mounting slot 312.

Figure 6B:
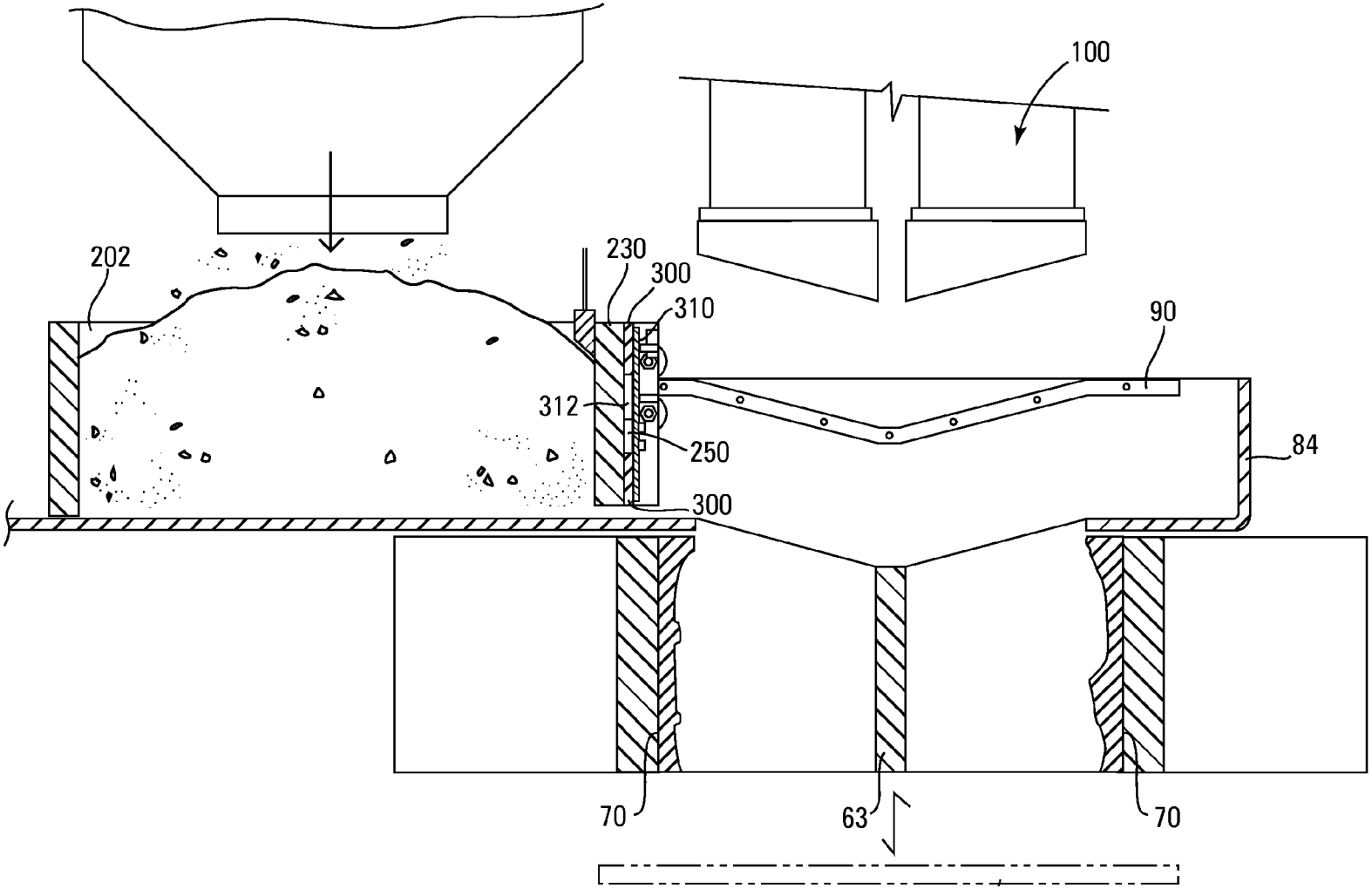

FIG. 6B shows a pre-determined amount of material, which may be a rugged, weather resistant material, such as a low slump concrete mix, as it exits the mix or feed hopper and enters the top opening of the feed drawer assembly 200. At this time of the production cycle, movable liners 72, if they are employed, are moved into place along with the production pallet 74 to close off individual mold cavities 52 (and 72 not shown) in preparation for mold cavity fill.

Figure 6C:
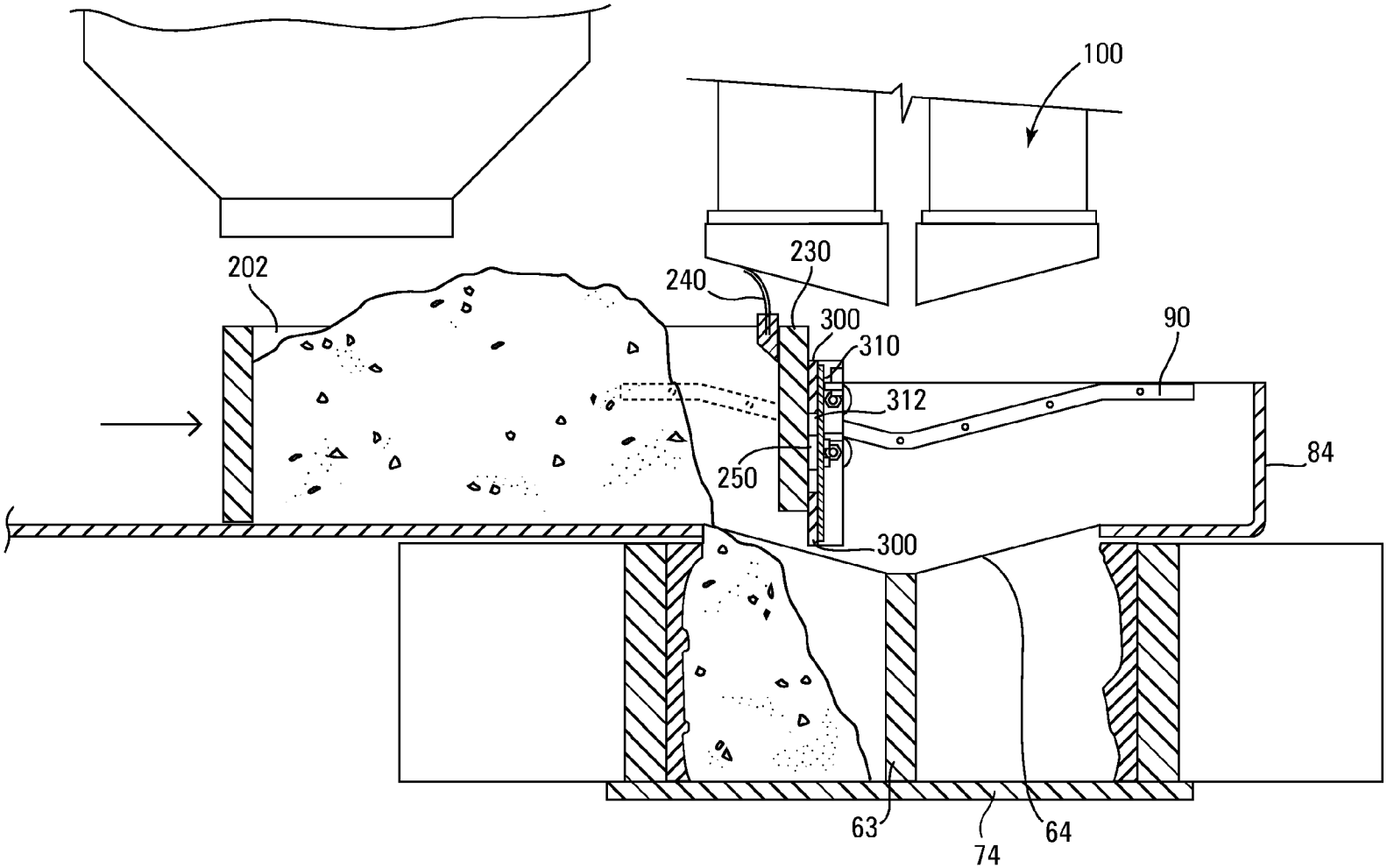
Figure 6D:
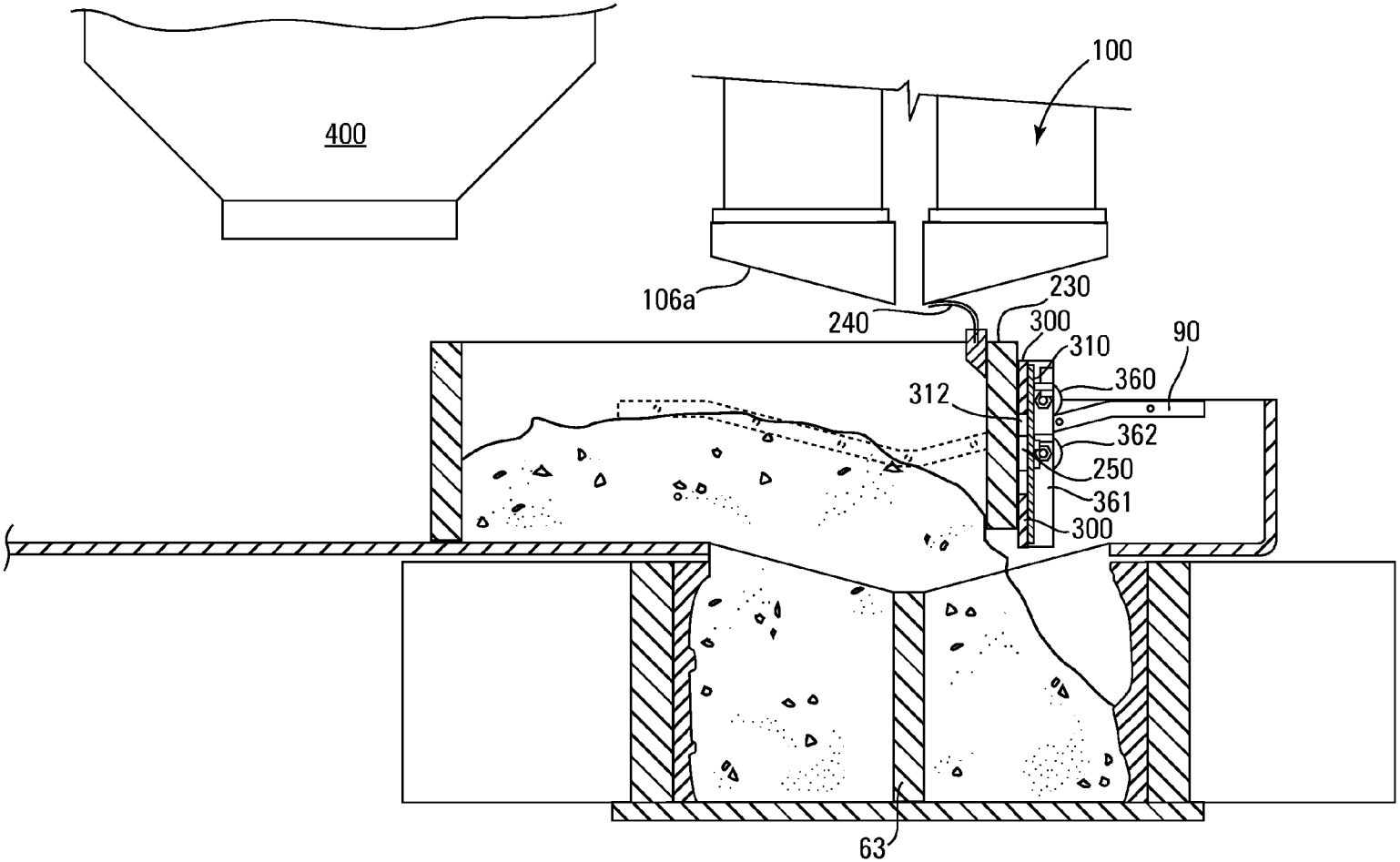
Figure 6E:
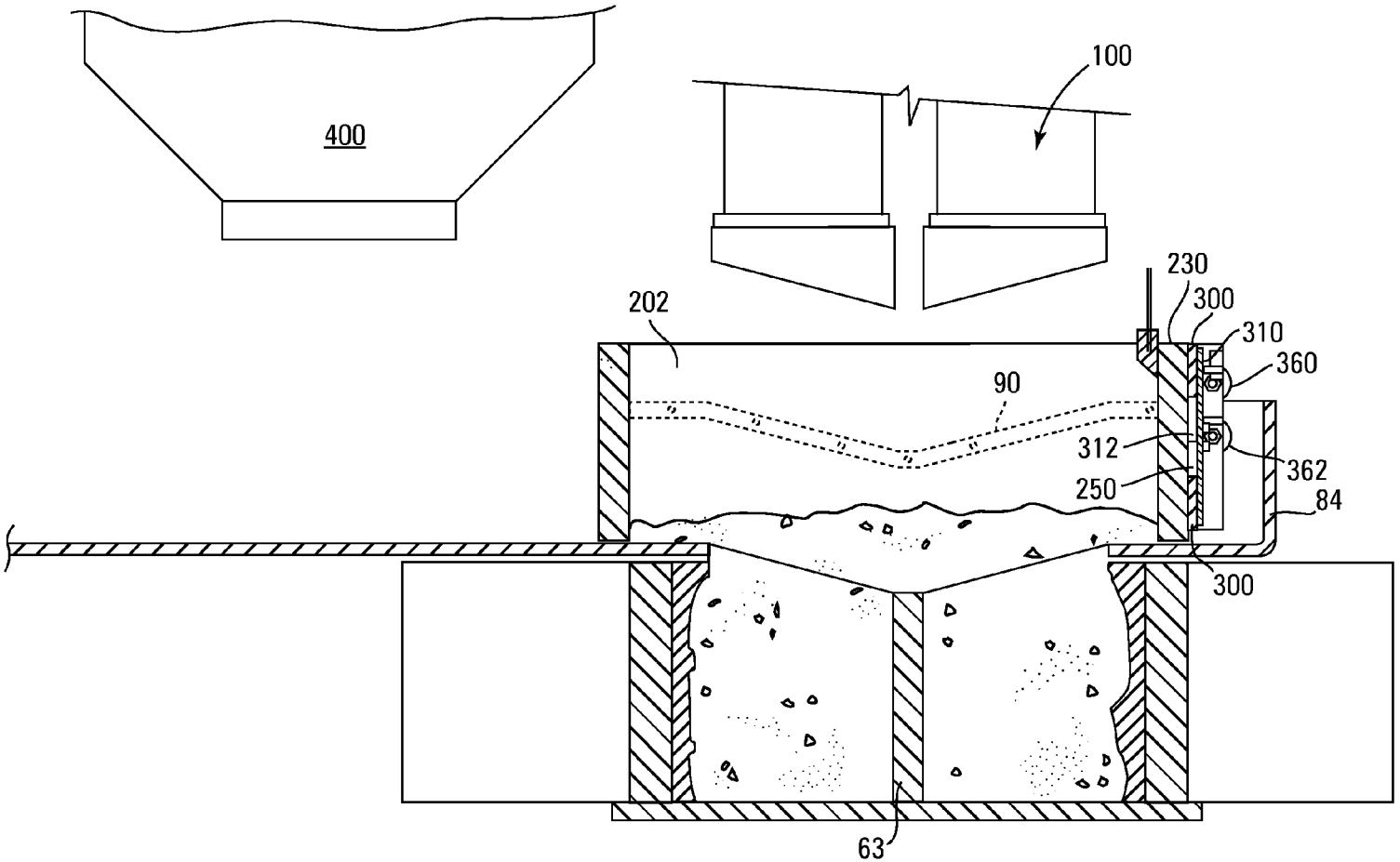

FIGS. 6C to 6E illustrates the feed drawer 202 being driven forward by the feed drawer mechanism from an initial or resting position to a second fully extended position. As the feed drawer proceeds forward the side rollers of the floating cut-off bar follow the declining angular contour of the side rails and are allowed vertical downward movement. Mounting bracket 310 is directly coupled to end panel 230 by mounting points 250 and 252 loosely connecting and housing but not fixedly attaching floating cut-off bar 300 between the mounting bracket and the end panel by bolts 311 through mounting slots 312 and 314. Mounting slots 312 and 314 are sized to allow the floating cut-off bar vertical movement along the side rail path. As the feed drawer progresses further forward and after it has reached the center division plate 63, the side rollers of the floating cut-off bar begin to follow an inclining contour of side rails 90 and 92. The floating cut-off bar is allowed upward vertical movement through mounting slots 312 and 314 as the floating cut-off bar follows the incline of the side rails. The feed drawer, as it moves forward, distributes material through its bottom opening into mold cavities 52 (and mold cavities 72 not shown) and brush 240 attached to the end panel of the feed drawer also cleans off waste debris located on the stripper shoes 106*a* (and 106*b* not shown) of the stripper shoe head assembly 100 as it passes underneath.

Figure 6F:
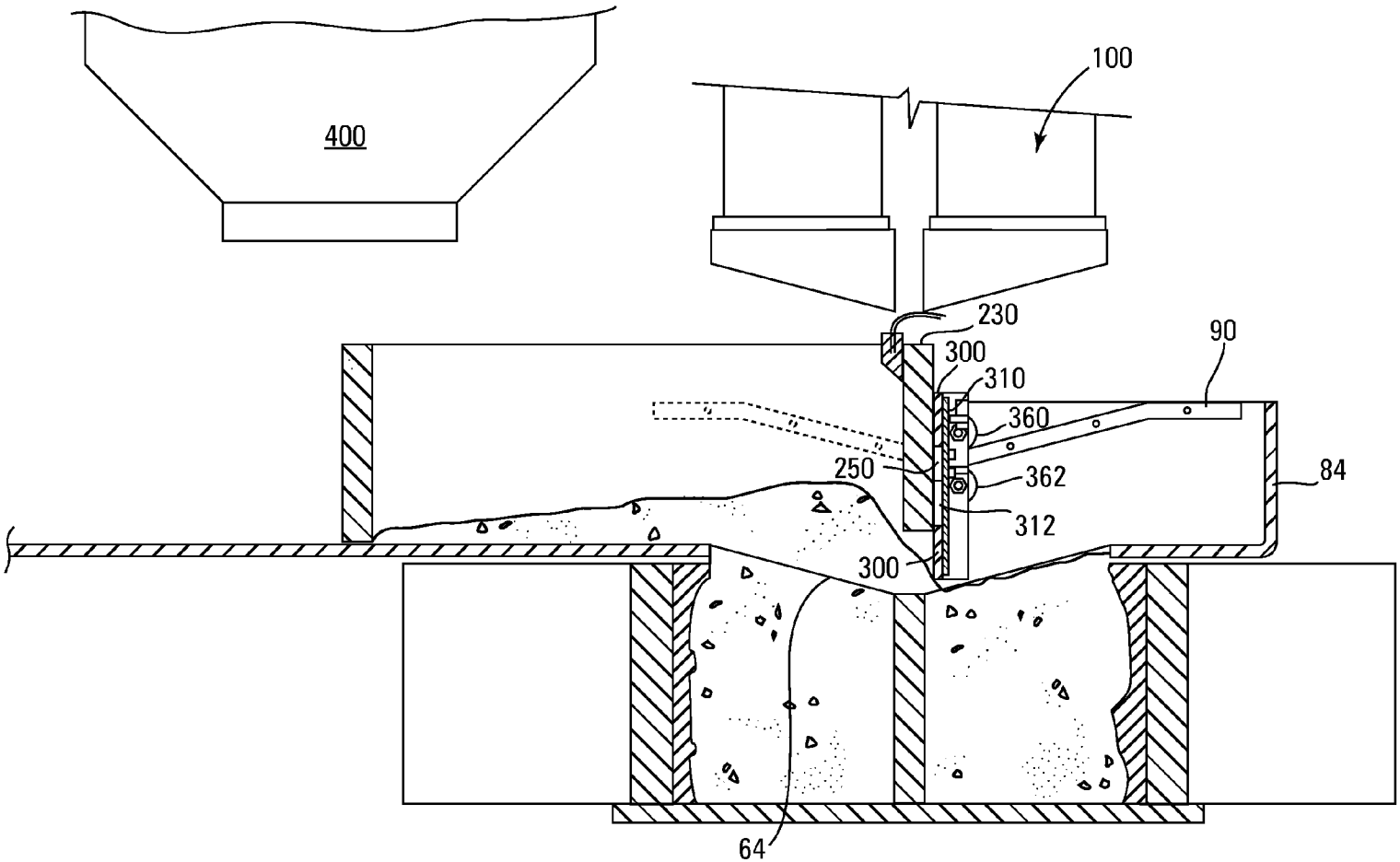
Figure 6G:
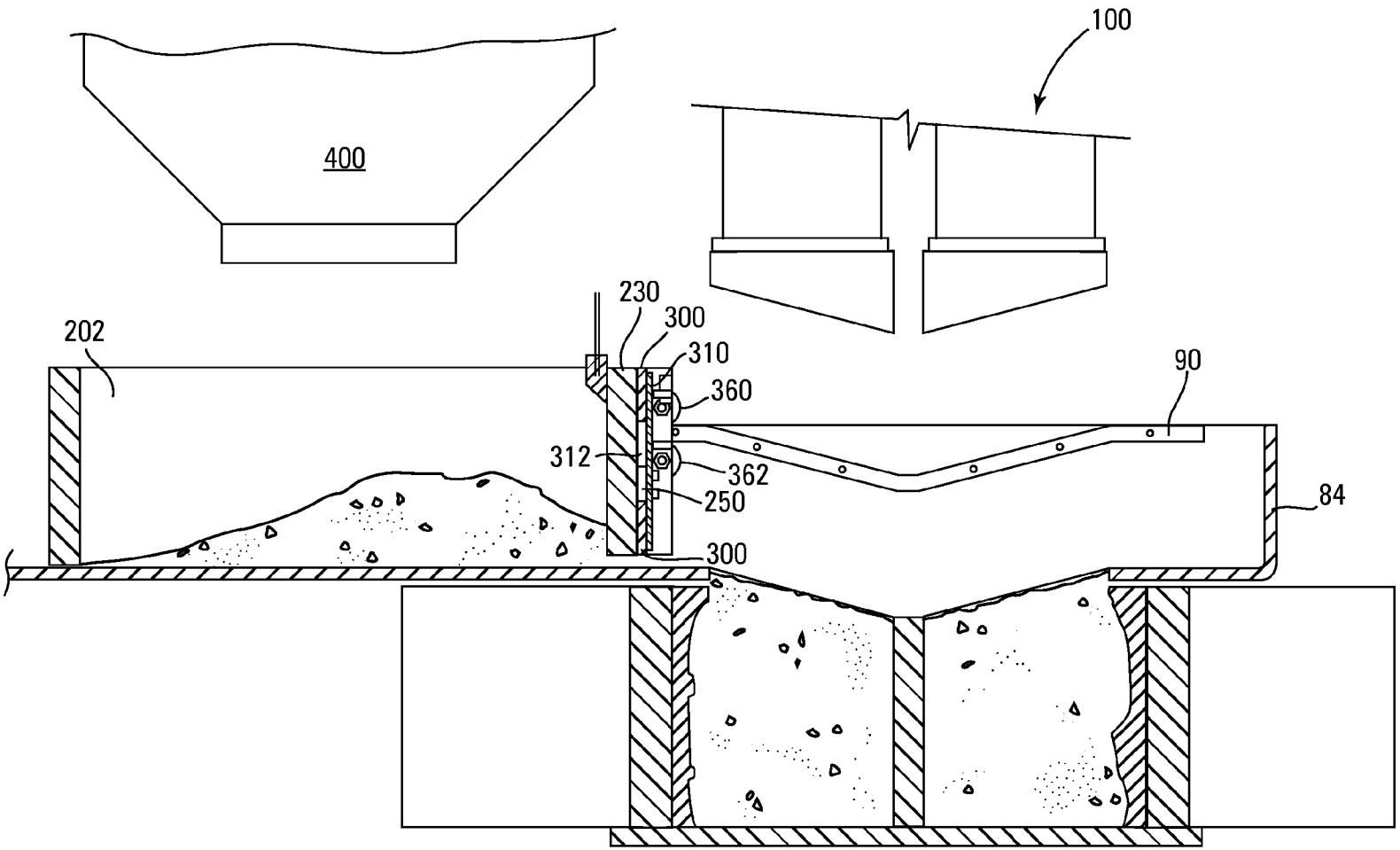

FIGS. 6F to 6G illustrates the feed drawer 202 being retracted by the feed drawer mechanism as known in the art from a second or extended position to an initial or resting position. As the feed drawer retracts back over the mold box the side rollers of the floating cut-off bar follow side rails 90 and 92 of the side walls of the spill pan and are allowed a vertical range of movement as discussed above. Tabs in the floating cut-off bar screed excess material in the mold cavity back through the bottom opening of the feed drawer and relocates excess material to areas of the mold cavity that may be lacking the proper specified amount.

The angle or contour of side rails 90 and 92 and hence the path of the floating cut-off bar is set to specifically deposit a greater amount of mix material in areas of the mold which typically require more material. For example, it is desirable to deposit additional material in close proximity to movable liner 70 of the mold box cavity so as to allow for excess material to be compacted into the 3-dimensional texture imprint of the movable side liners 70. Thus, the angle or contour of the side rails need not be the actual angle of the side of the block being produced. The side rails could also be given a stepped contour or any necessary shaped contour as needed by the specific shape and size of the block being produced in the mold cavity. Two non-limiting examples of such shapes or contours are shown in greater detail in FIGS. 7A and 7B and discussed further below. Once the feed drawer has retracted fully back to its resting or initial position to where it is ready to receive more mix from the mix hopper, and the cut-off bar has fully retracted, a vibration cycle is started to help consolidate and compact the concrete mix into all areas and crevasses of the mold box cavity.

Figure 6H:
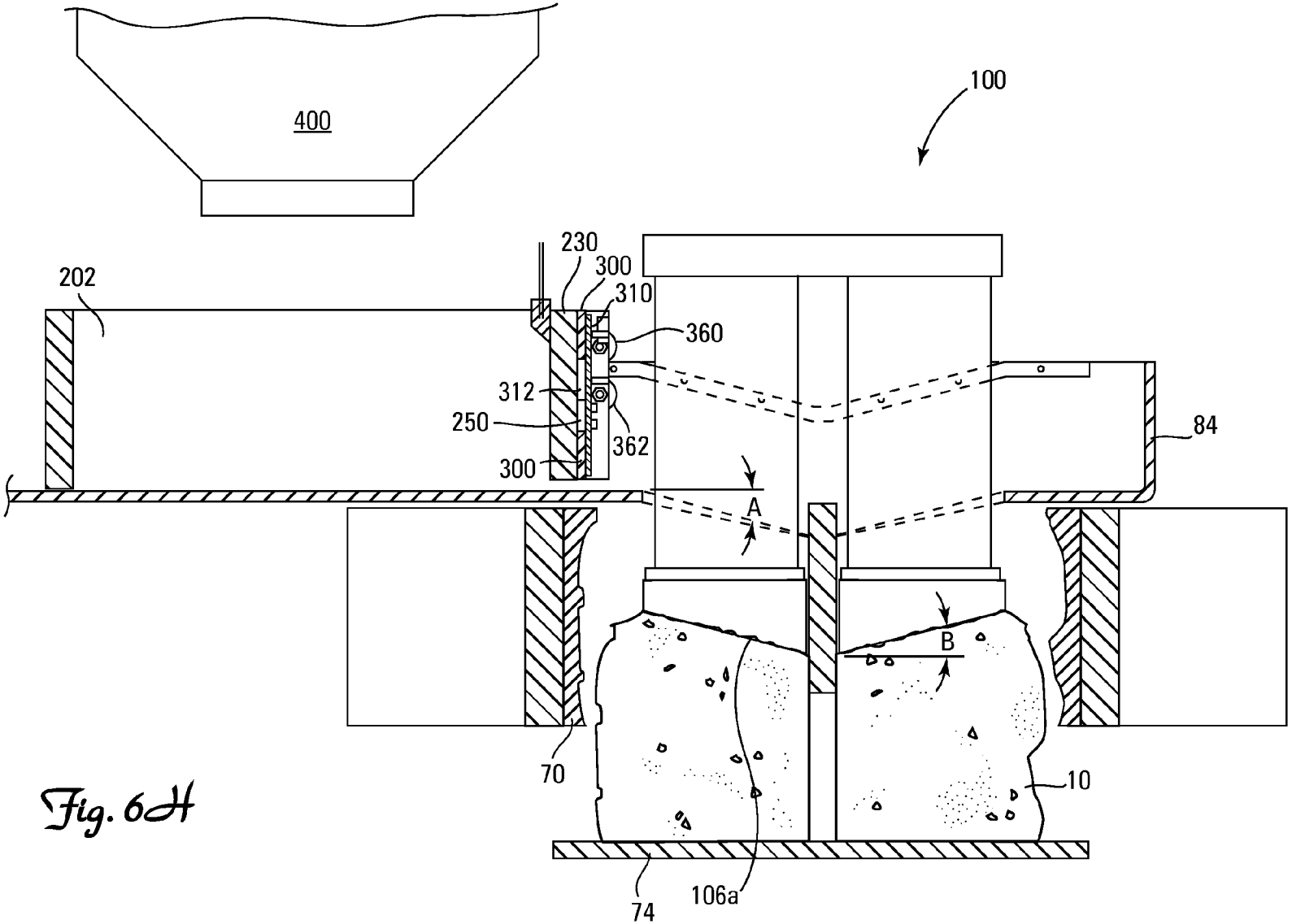

FIG. 6H illustrates the end of the production cycle after the vibration cycle has stopped and the movable side liners have retracted and whereby the stripper shoe compression head assembly has been lowered into mold box 50 and engaged the material in each mold cavity and compressed it to a specified density. Since the precise amount of excess material necessary for proper compression has been uniformly achieved because of the accurate distribution of material from the floating cut-off bar's engagement of the specified contour of the spill pan side rails, proper structural integrity and strength of the block in accordance with the proper specified density requirements is achieved.

Excess filling of mix material in a mold cavity for more precise control of a products uniform density may be referred to as over cover. This over cover is exemplified by angle A which is the slope of the contoured path of side rails 90 and 92 and angle B which is the slope of the finished product and is the same slope as the angular stripper shoes. Angle A of the division plate is larger than that of the finished products angle B and signifies the amount of compression that applies to the product as compaction occurs. The stripper shoes 106*a* of the stripper shoe head 100 then push the block 10 out of the mold box, at which point the production pallet with the final product moves downward and out from under the mold box. It then proceeds to move laterally along a conveyor line to make available the space for the next production pallet to move in under the mold box and up into position contacting the bottom of the mold for the next production cycle.

Figure 7A:
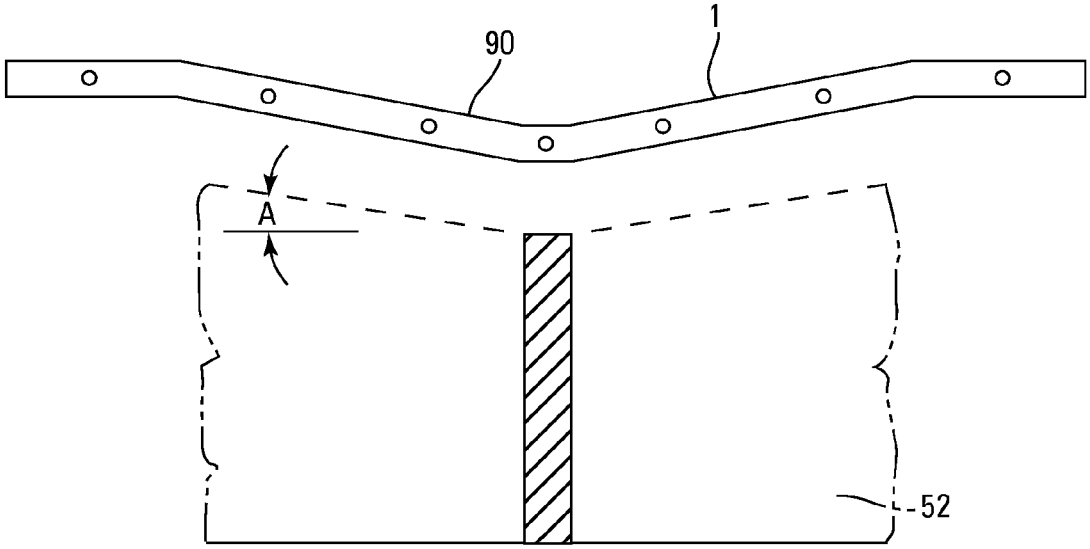
FIGS. 7A and 7B are front views of mold box side rails with varying contours, the contours being selectable to offer varying amounts of mix material to be deposited into mold cavities of a block being formed in a mold box.
Figure 7B:
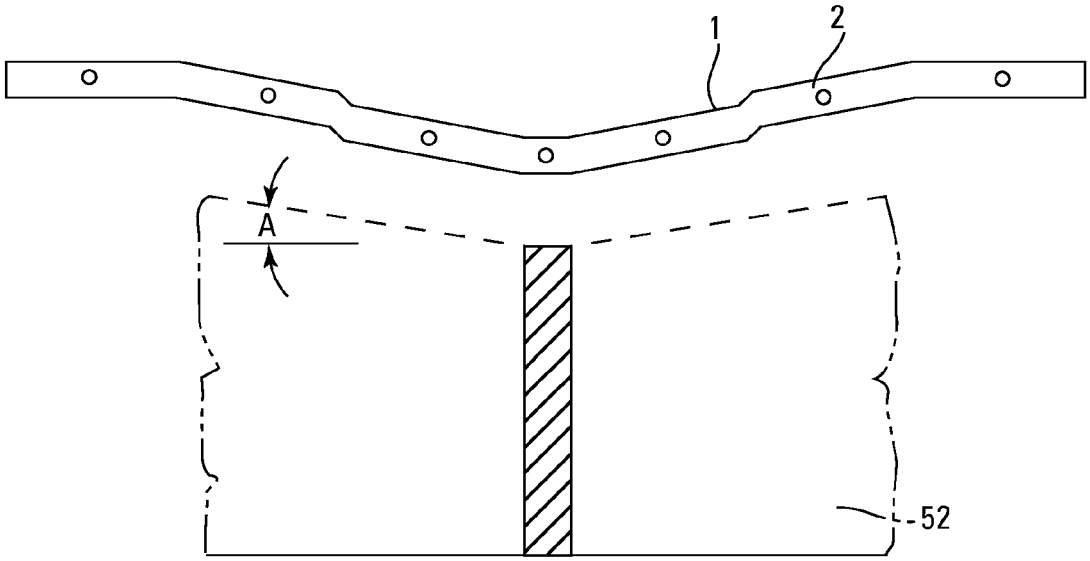

FIGS. 7A and 7B illustrate over cover which is the distribution of excess material during a production cycle into each individual mold cavity as necessary for proper block integrity. More specifically, over cover refers to the precise distribution pattern of the side rails and optionally the angled division plate to meter out a correct and specific proportion of material to fill the mold cavities and to also add additional material as necessary in specific areas of the mold cavity to infill increased void space of the stone shaped texture (or any shaped texture) of the movable liners (or any other three-dimensional liners) employed by the mold cavity. The three-dimensional pattern/texture on the movable liners (or other liners) is the negative image or pattern of the imparted texture that is applied to the mold. Over cover allows for compaction by vibration and stripper shoe compression to achieve greater uniform density of product necessary for proper block strength and integrity and additional leaves a specifically proper positive image or pattern (convex) on the unit or block being produced. The average over cover for a mold cavity is around 8%. FIG. 7A illustrates a single slope side rail path in mold cavity 52. The single slope provides an example of the over cover above the actual unit height that encompasses a range from 8% to 11% of additional material over the slope of the contoured path of the side rail. The 8% over cover begins at the shallowest part of the mold cavity where there are relatively few textures and structures that need additional material. The gradient of the slope increases to 11% where the greatest amount of material is needed to fill in the areas of 3-dimensional texture as imprinted in this example by the moveable side liners. The area shown in dash indicates the particular block shape of this current example. FIG. 7B illustrates a double slope side rail path in a second embodiment of mold cavity 52. The over cover of this double slope has a range of over cover for both slopes. The range of slope 1 is from 8% to 11% of over cover and the range of slope 2 is from 11% to 18% of over cover. The steeper second slope may be applicable in certain applications where even more material is needed for larger 3-dimensional texturing, from the moveable liners. It should be noted that a slight incline/decline may be employed between the two slopes for greater ease and durability of the side rollers of the floating cut-off bar as it follows the path of the spill pan side rails during the production cycle. As can be seen from FIGS. 7A and 7B the slope of the side of the block formed in the mold is less than the slope of the angled division plate for compression of excess material. The slope of the angle of the side rails used in an application can have any slope or angle as desired but an average range of about 10% to 20% of over cover may be desirable.

Figure 8:
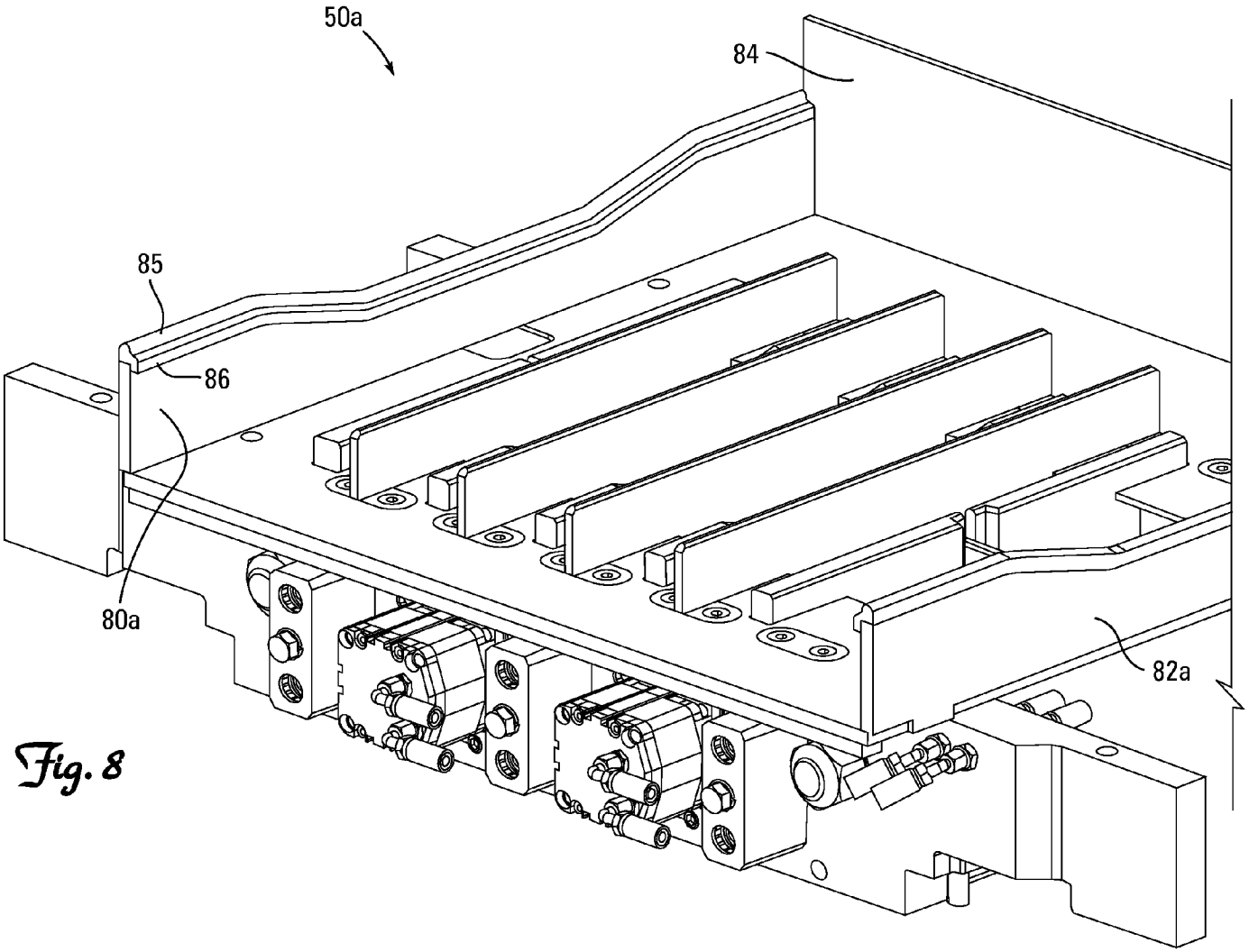
FIG. 8 is a perspective view of an alternate embodiment of a mold box of the present invention.
Figure 9:
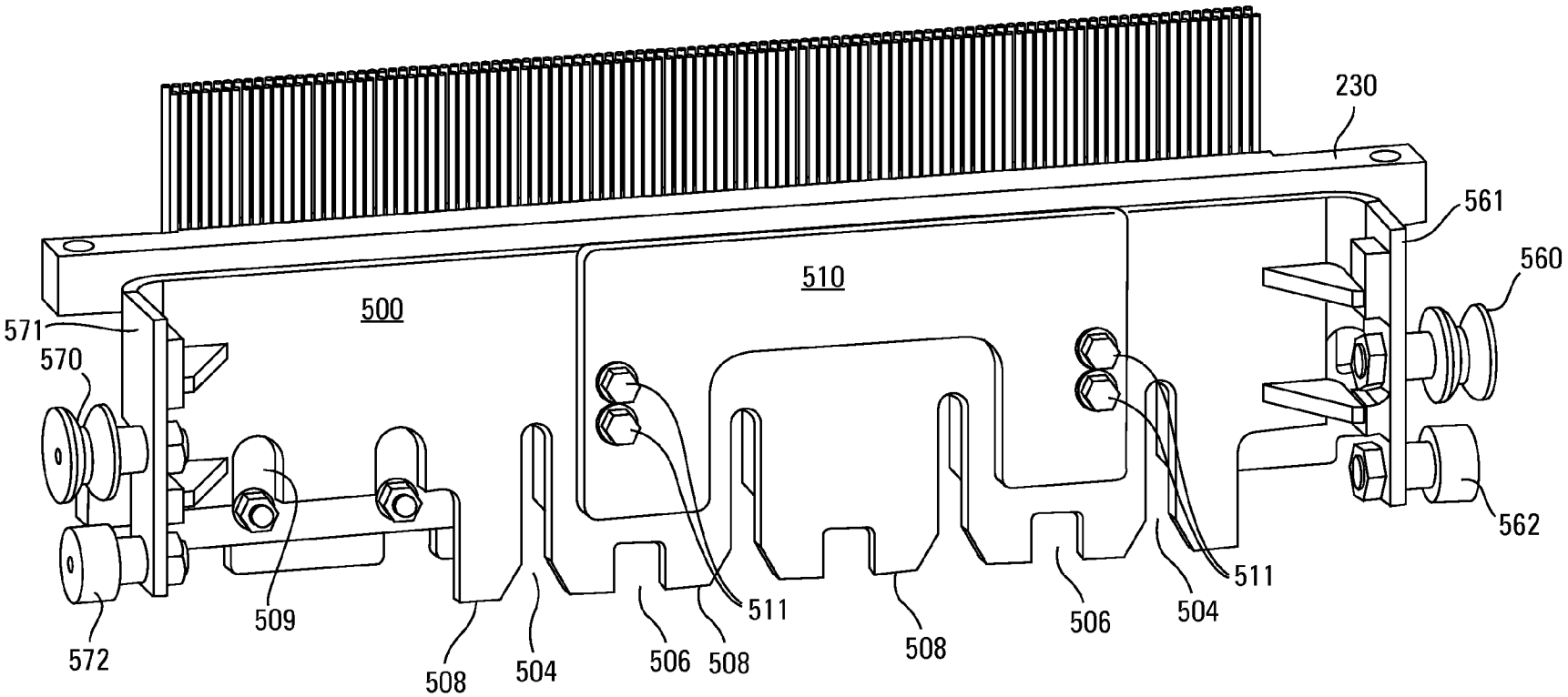
FIG. 9 is a perspective view of an alternate embodiment of a floating cut-off bar of the present invention.
Figure 10:
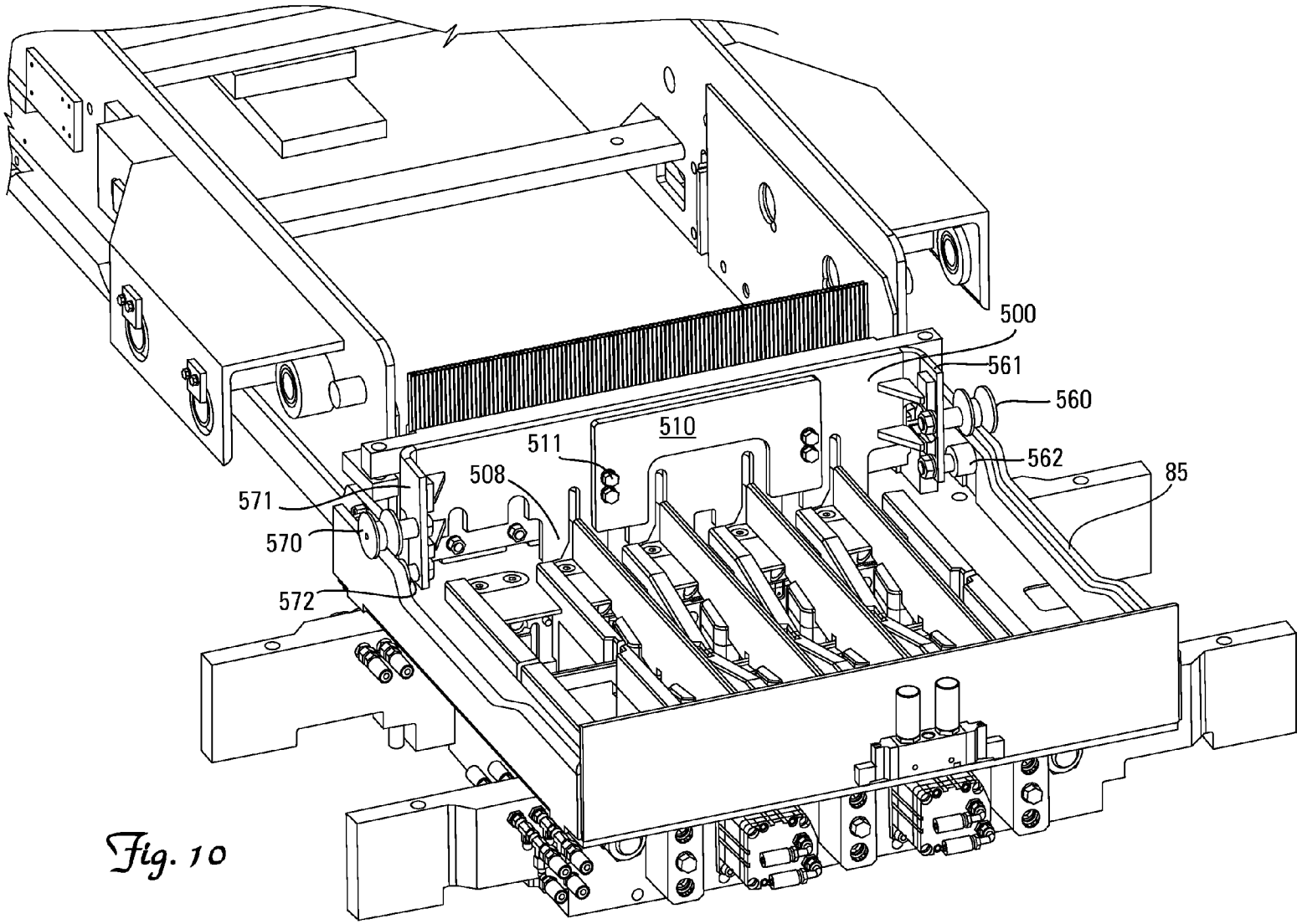
FIG. 10 is a front perspective view of a feed drawer assembly and mold box of FIG. 8.

FIGS. 8 to 11B illustrate an alternate embodiment to the floating cut-off bar system of the present invention. Mold box 50*a*, as seen in FIGS. 8 and 10 is substantially similar to mold box 50 as shown in FIGS. 1A to 2B. Mold box 50*a* has been manufactured with a precise, predetermined and controlled material distribution pattern that has been cut or formed along the top surface of spill pan side walls 80*a* and 82*a*. Mold cavities of mold box 50*a* are formed by angled division plates and/or side division plates, and/or end liners that form the sides walls of the mold cavity, which, along with moveable side liners and a center division plate that form the end walls of the mold cavity, define a plurality of mold cavities having open mold cavity tops and open mold cavity bottoms. The division plates may have two different shapes. The side division plate may have a substantially parallel top and bottom surfaces, while the angled division plate may have an angular sloping top shape. The angle and contour of the angled division plates may mimic or duplicate the precise, predetermined and controlled material distribution pattern defined by the top surface of spill pan side walls 80*a* and 82*a*. The distribution pattern defined by the top surface of the spill pan side walls allows proper material distribution into the mold cavities of mold box 50*a* as a feed drawer moves forward and backward as it travels its path over the mold box to deliver and screed off the mix material. As the feed drawer returns over the mold to its start position, any excess material that exists over the predetermined compaction height (approximate 0.375 of an inch to 1.0 inch) will be screeded off the top by the floating cut-off bar and the excess material will be allowed to flow back into the feed drawer. It should be noted that this pattern is not limiting and any pattern could be given to spill pan side walls and the division plate or plates for the production of different sizes and shapes of blocks and material distribution patterns depending upon the application and the desired shape of the blocks formed in the mold box. It should be further noted that the division plate need not have the angled or contoured pattern as that of the spill pan side walls and could have substantially parallel top and bottom surfaces.

The top surface of spill pan side rails 80*a* and 82*a* may optionally be provided with a rail cap 85 which may be made out of steel of another suitable material and is attached by welding or other suitable attachment means to the top surface of the determined distribution pattern cut into the spill pan side walls 80*a* and 82*a*. Roller cap 85 caps the top surface of the spill pan side wall and has roller guard 86 which protrudes a predetermined distance past the top surface of the spill pan side wall out over the mold box 50*a* as shown in better detail in FIG. 11A. The roller cap 85 may be manufactured with any desired contour to match the contour of the rollers of the floating cut-off bar as discussed below.

FIG. 9 is a front perspective view of an alternate floating cut-off bar 500 of the present invention and is substantially similar to floating cut-off bar 300. In FIG. 9 end panel 230 is shown detached from the remainder of a feed drawer (as discussed above) in order to better show the floating cut-off bar and its manner of slideable attachment. Floating cut-off bar 500 has core bar slots 504 that allow the floating cut-off bar to fit over core bars of mold box 50*a* with additional space to allow for the up and down movement of the floating cut-off bar as it travels the entire horizontal path of the feed drawer 202 from the resting or first position to the second extended position back to the resting position and additionally as the floating cut-off bar vertically moves with the angular pattern of spill pan side walls 80*a* and 82*a*, which may also be the angular pattern of the angled division plates of mold box 50*a*. Slots 50*a* also allow for vertical movement of floating cut-off bar 500. Notches 506 allow the floating cut-off bar to ride over the vertical angular division plates and may be sized so that notches 506 are in contact with the top surfaces of angular division plates to screed away any left over material on the top surface of the division plates after material distribution has occurred or may be sized so that there is some distance between the top surface of the division plate and the notch.

As floating cut-off bar 500 retracts from the second extended position after material has been distributed to the mold cavities along the path of spill pan side walls 80*a* and 82*a*, tabs 508 descend into the mold cavities of mold box 50*a* a predetermined distance and screed excess material back into the feed drawer or redistribute material to areas that do not contain the sufficient amount of material. Bolts 511 secured to mounting points of end panel 230 of the feed drawer are coupled to mounting bracket 510. Side rollers 560, 562 are attached to bracket 561 and side rollers 570 and 572 are attached to bracket 571 by bolts or other suitable means of attachment. Brackets 561 and 571 are coupled to the floating cut-off bar through welding or other attachment means. Side rollers 560 and 570 extend a further distance away from the floating cut-off bar then side rollers 562 and 572. As the feed drawer drive mechanism extends the feed drawer and floating cut-off bar from the resting position to an expanded material distributing position the side rollers 560 and 570 of the floating cut-off bar ride above the spill pan side walls 80*a* and 82*a* on top of roller cap 85 of mold box 50*a* and side rollers 562 and 572 of the floating cut-off bar ride below roller guard 86 of mold box 50*a*. Side roller 562 and 572 help prevent the floating cut-off bar from slippage and disengagement from the roller cap 85 as the floating cut-off bar 500 extends and retracts. The predetermined contoured path the side rollers follow on the spill pan side walls allows the floating cut-off bar to vertically move up and down as the feed drawer is extended forward and material is distributed to the mold box due to the vertical mobility granted to the floating cut-off bar. Once the material has been distributed by the feed drawer, the feed drawer retracts and the floating cut-off bar and the side rollers of the floating cut-off bar follow the same path of the spill pan side walls back over roller cap 85 to the original or resting position. The distribution pattern of the spill pan side walls allows for maximum control of the produced block's structural strength and integrity, and thus a structure's structural strength and integrity produced from such a block. It should be noted that the contoured path of the spill pan side walls that the floating cut-off bar follows is provided as an example and is not limiting and could have any contoured shape as differing block specifications require.

Figure 11A:
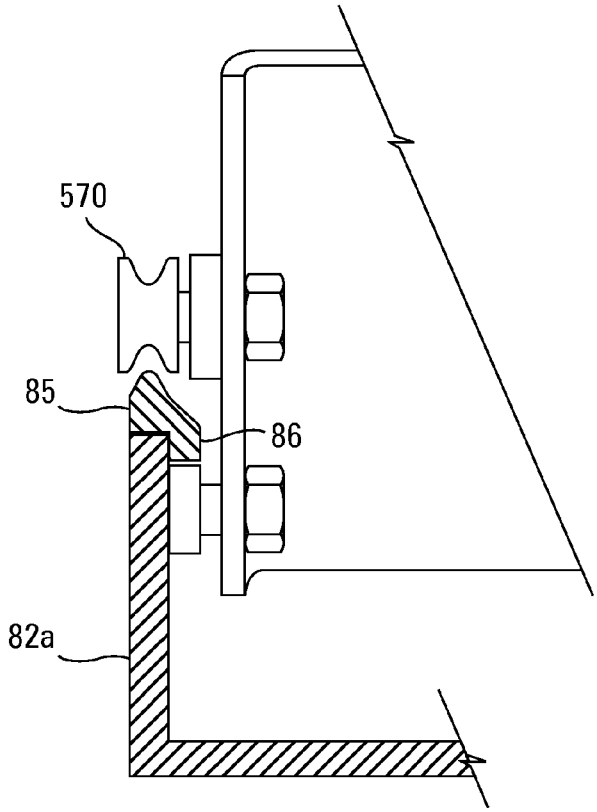
FIGS. 11A and 11B are front views of alternate embodiments of roller and roller cap contours of the present invention.
Figure 11B:
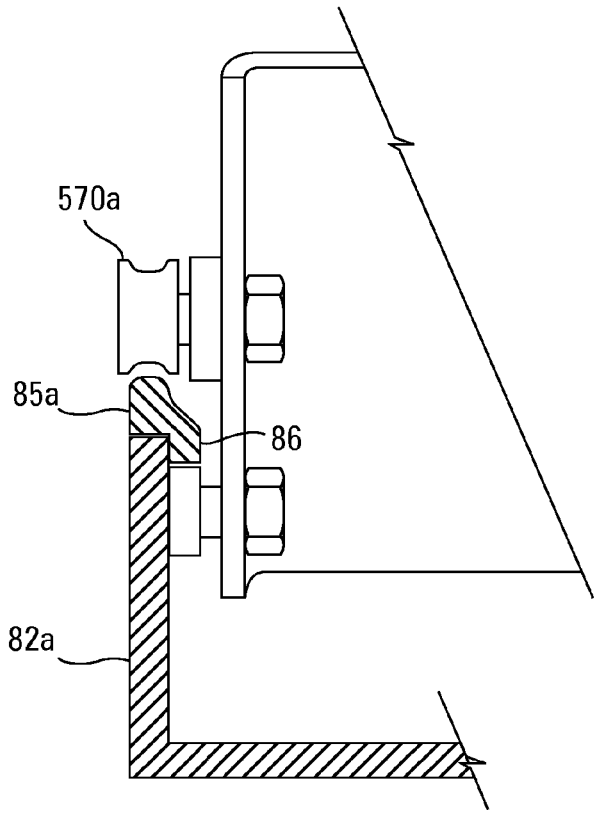

FIG. 11A illustrates a cross sectional view of the embodiment of the roller and roller cap system of FIGS. 8 and 10. Roller 570 has a curvilinear v-shaped contour which rides and follows the curvilinear v-shaped contour of roller cap 85. FIG. 11B illustrates an embodiment of the roller and roller cap system of the present invention where roller 570*a* has a rounded contour which rides and follows the rounded contour of roller cap 85*a*. It should be noted that the shapes of the roller and roller caps are not limiting and therefore could have any desired contour as desired.

Although particular embodiments have been disclosed herein in detail, this has been done for purposes of illustration only, and is not intended to be limiting with respect to the scope of the following appended claims. In particular, it is contemplated by the inventor that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein. Further, although the invention has been described in connection with blocks having inconsistent heights, densities and surface deformities it should be understood that these inventive concepts and embodiments are also applicable to assist in height control, correct distribution of density and aesthetic improvement to block surface conditions caused by any reason.

What is claimed is:

1. A mold assembly for producing wall blocks comprising:

a production pallet;

a stripper shoe;

a mold box having opposed side walls and opposed end walls which together form a perimeter of the mold box, the mold box having an open top and an open bottom, the production pallet enclosing the open bottom of the mold box during a block forming process, the mold box including a spill pan having first and second side walls and an end wall, the first and second side walls of the spill pan having a non-linear top surface;

a control member including first and second cap elements and first and second protruding elements, the first and second cap elements each having a non-linear upper surface, the first and second cap elements being positioned over the top surfaces of the first and second side walls of the spill pan, respectively, the first and second protruding elements extending inwardly from the first and second side walls of the spill pan, respectively, and having a non-linear lower surface;

a feed drawer configured to move during the block forming process from a first position vertically offset from the mold box to a second position above the mold box and back to the first position and to discharge block forming material into the mold box during the block forming process;

a material distribution element moveably connected to the feed drawer and configured to remove excess block forming material from the mold box or redistribute block forming material in the mold box as the feed drawer moves from the second position to the first position during the block forming process;

a first pair of riding elements including a top riding element and a bottom riding element extending from a first side of the material distribution element and a second pair of riding elements including a top riding element and a bottom riding element extending from a second side of the material distribution element, the top riding elements extending from the material distribution element a greater distance than the bottom riding elements, the top riding element of the first pair and the top riding element of the second pair being positioned and shaped to ride over the upper surface of the first and second cap elements, respectively, as the feed drawer moves between the first and second positions during the block forming process and the bottom riding element of the first pair and the bottom riding element of the second pair being positioned and shaped to ride under the lower surface of the first and second protruding elements, respectively, as the feed drawer moves between the first and second positions during the block forming process; and wherein the control member is configured to control a path of travel of the material distribution element over the mold box as the feed drawer moves from the second position to the first position during the block forming process, the path of travel being defined by the non-linear surfaces of the cap elements and protruding elements, a height of the material distribution element above the production pallet changing as the material distribution element moves along the path of travel during the block forming process.

2. The mold assembly of claim 1 wherein the material distribution element is a cut-off bar.

3. The mold assembly of claim 1 wherein the top and bottom riding elements of the first and second pairs of riding elements comprise rollers.

4. The mold assembly of claim 1 wherein the material distribution element is connected to be moveable with respect to the feed drawer from a downward position to an upward position.

5. The mold assembly of claim 1 wherein the material distribution element is oriented parallel to the end walls of the mold box.

6. The mold assembly of claim 5 wherein the end walls include first and second end walls and wherein the path of travel of the material distribution element over the mold box is from the first end wall to the second end wall.

7. The mold assembly of claim 1 wherein the stripper shoe has a lower surface configured to compress block forming material in the mold box during the block forming process, the lower surface being angled from horizontal at an angle α.

8. The mold assembly of claim 7 wherein angle α is in the range of about 5° to 20°.

9. A mold assembly for producing wall blocks comprising:

a production pallet;

a stripper shoe;

a mold box having opposed side walls and opposed end walls which together form a perimeter of the mold box, the mold box having an open top and an open bottom, the production pallet enclosing the open bottom of the mold box during a block forming process, the mold box including a spill pan having first and second side walls and an end wall;

first and second non-linear guide members positioned above the mold box, each non-linear guide member defining an upper surface and a lower surface;

a feed drawer configured to move during the block forming process from a first position vertically offset from the mold box to a second position above the mold box and back to the first position and to discharge block forming material into the mold box during the block forming process;

a material distribution element moveably connected to the feed drawer and configured to remove excess block forming material from the mold box or redistribute block forming material in the mold box as the feed drawer moves from the second position to the first position during the block forming process;

a first pair of rollers including a top roller and a bottom roller extending from a first side of the material distribution element and a second pair of rollers including a top roller and a bottom roller extending from a second side of the material distribution element, a distance between the top rollers being greater than a distance between the bottom rollers, the top roller of the first pair and the top roller of the second pair being positioned and shaped to ride over the upper surface of the first and second non-linear guide members, respectively, as the feed drawer moves between the first and second positions during the block forming process and the bottom roller of the first pair and the bottom roller of the second pair being positioned and shaped to ride under the lower surface of the first and second non-linear guide members, respectively, as the feed drawer moves between the first and second positions during the block forming process; and wherein a movement of the rollers over the non-linear guide members defines a path of travel of the material distribution element over the mold box as the feed drawer moves from the second position to the first position during the block forming process, a height of the material distribution element above the production pallet changing as the material distribution element moves along the path of travel during the block forming process.

10. The mold assembly of claim 9 wherein the material distribution element is a cut-off bar.

11. The mold assembly of claim 9 wherein the material distribution element is connected to be moveable with respect to the feed drawer from a downward position to an upward position.

12. The mold assembly of claim 9 wherein the material distribution element is oriented parallel to the end walls of the mold box.

13. The mold assembly of claim 12 wherein the end walls include first and second end walls and wherein the path of travel of the material distribution element over the mold box is from the first end wall to the second end wall.

14. The mold assembly of claim 9 wherein the stripper shoe has a lower surface configured to compress block forming material in the mold box during the block forming process, the lower surface being angled from horizontal at an angle α.

15. The mold assembly of claim 14 wherein angle α is in the range of about 5° to 20°.

* * * * *